US009365221B2

(12) United States Patent
Burke et al.

(10) Patent No.: US 9,365,221 B2
(45) Date of Patent: Jun. 14, 2016

(54) UNIVERSAL BRAKE BEAM STRUT

(71) Applicant: Schaefer Equipment, Inc., Warren, OH (US)

(72) Inventors: Michael K. Burke, Wheaton, IL (US); Ronald D. Golembiewski, Chicago, IL (US); Walter J. Peach, Montgomery, IL (US); David R. Cline, Canfield, OH (US)

(73) Assignee: Schaefer Equipment, Inc., Warren, OH (US)

( * ) Notice: Subject to any disclaimer, the term of this patent is extended or adjusted under 35 U.S.C. 154(b) by 0 days.

(21) Appl. No.: 14/337,755

(22) Filed: Jul. 22, 2014

(65) Prior Publication Data

US 2016/0023673 A1 Jan. 28, 2016

(51) Int. Cl.
*B61H 13/36* (2006.01)

(52) U.S. Cl.
CPC ..... *B61H 13/36* (2013.01)

(58) Field of Classification Search
CPC ..... B61H 13/36; B61H 13/00
USPC ..... 188/229.1, 229.6, 231–232, 219.1, 188/223.1, 226.1
See application file for complete search history.

(56) References Cited

U.S. PATENT DOCUMENTS

| | | | | | |
|---|---|---|---|---|---|
| 2,170,114 | A | * | 8/1939 | Busch | 188/226.1 |
| 2,330,748 | A | * | 9/1943 | Sagstetter | 188/229.6 |
| 2,433,773 | A | * | 12/1947 | Macey et al. | 188/210 |
| 2,528,024 | A | * | 10/1950 | Whitney | 188/229.6 |
| 2,702,614 | A | | 2/1955 | Spaeth | |
| 2,973,063 | A | * | 2/1961 | Spaeth | 188/229.6 |
| 3,115,221 | A | * | 12/1963 | Croft | 188/229.6 |
| 4,830,148 | A | | 5/1989 | Hart et al. | |
| 5,810,124 | A | | 9/1998 | Sandmann | |
| 6,155,388 | A | | 12/2000 | Sandmann | |
| 6,155,389 | A | | 12/2000 | Sandmann | |
| 6,193,028 | B1 | | 2/2001 | Elizalde-Siller et al. | |
| 6,234,283 | B1 | | 5/2001 | Montes-Ramos | |
| 7,341,128 | B2 | | 3/2008 | Ring et al. | |
| 7,410,037 | B2 | | 8/2008 | De La Fuente-Farias | |
| 7,849,981 | B2 | | 12/2010 | De la Fuente-Farias | |
| 7,931,130 | B2 | | 4/2011 | Ring | |
| 2006/0108187 | A1 | | 5/2006 | Steffen et al. | |

* cited by examiner

*Primary Examiner* — Christopher Schwartz
(74) *Attorney, Agent, or Firm* — The Webb Law Firm

(57) ABSTRACT

A strut for a brake beam assembly includes a strut body extending along a longitudinal axis between a proximal end and a distal end. At least one slot is defined in the strut body and receives and supports a brake lever extending non-parallel to the longitudinal axis. A compression member engager is connected to a distal end of the strut body and is configured to connect the strut body to a compression member of the brake beam assembly. A tension member engager is connected to the proximal end of the strut body and is configured to engage a tension member of the brake beam assembly. At least one fastener is configured to engage the compression member engager to fasten the compression member engager on the compression member. At least a portion of the strut body is rotatable about the longitudinal axis with respect to the compression member engager and the tension member engager to be oriented at opposing angles with respect to a horizontal plane extending through the longitudinal axis.

17 Claims, 29 Drawing Sheets

UNIVERSAL BRAKE BEAM STRUT

BACKGROUND OF THE INVENTION

1. Field of the Invention

The present disclosure relates to a strut for mounting a brake lever of a brake actuator to a brake beam assembly in a railway car vehicle. In one embodiment, a reversible strut may be used to mount the brake lever on the brake beam assembly in a right-hand or left-hand configuration.

2. Description of Related Art

Railway freight cars typically include four brake beams, each associated with a particular set of wheels at the front or rear of the car. The brake beams are comprised of a compression member carrying brake shoes at the ends thereof and a V-shaped tension member. An air brake cylinder is mounted on the freight car and is associated with the brake beams by a brake rod that connects to a lever extending through a strut of the brake beam assembly, which extends between the compression member and the tension member. The brake shoes are applied to the wheels to slow the car by activating the air brake assembly to pull the brake rods, which actuate the lever to move the compression members in the direction of the wheels.

Such brake systems require that the brake lever extends through the strut at an angle with respect to a horizontal plane and, thus, during manufacture, the brake beam assembly is made in one of a right-hand or a left-hand configuration. Accordingly, railway operators are required to stock both right-hand and left-hand brake beam components for replacement and maintenance, contributing to greater input of material cost for keeping sufficient numbers of replacement supplies and greater storage and transportation needs. One solution to this problem has been to manually alter a brake beam by cutting a bolt connecting the strut to the compression and tension members, rotating the strut, and then re-securing the strut. This solution requires additional labor by the railway operator and may weaken the structural integrity of the brake beam assembly.

SUMMARY OF THE INVENTION

Accordingly, there is a general need in the art for a universal brake beam assembly, wherein the strut is connected between the compression member and the tension member to be easily rotatable and reversible in order to convert the brake beam assembly from a right-hand to a left-hand configuration without significant input of labor or disassembly and physical alteration of the brake beam assembly.

According to one embodiment, a reversible brake beam is provided, which utilizes a universal strut that can be rotated to be placed in either a right-hand or left-hand configuration without requiring removal of fasteners or other portions of the brake beam. This allows for easy modification of the brake beam assembly from a right-hand to a left-hand configuration, and vice versa, which cuts down on inventory for the railway operator and cuts down on component inventory for the manufacturer.

According to one particular embodiment, a strut for a brake beam assembly is provided. The strut includes a strut body extending along a longitudinal axis between a proximal end and a distal end, the strut body including at least one slot defined in the strut body configured to receive and support a brake lever extending through the strut body non-parallel to the longitudinal axis of the strut body, a compression member engager configured to connect the strut body to a compression member of the brake beam assembly, the compression member engager being connected to the distal end of the strut body, and a tension member engager configured to engage a tension member of the brake beam assembly, the tension member engager being connected to the proximal end of the strut body. A first portion of the strut body at least partially defining the proximal end of the strut body and the distal end of the strut body is non-rotatably connected to the compression member engager and the tension member engager. A second portion of the strut body at least partially defining the at least one slot is rotatable about the longitudinal axis of the strut body with respect to the compression member engager and the tension member engager such that the at least one slot may be oriented at opposing angles with respect to a horizontal plane extending through the longitudinal axis of the strut body.

According to another embodiment, a brake beam assembly is provided. The brake beam assembly includes a compression member having a first end and a second end, a tension member having a first end and a second end and a substantially V-shape defining an apex, the first and second ends of the tension member being connected to the first and second ends of the compression member, respectively, a strut extending between the compression member and the apex of the tension member, a brake head directly or indirectly connected to each of the first and second ends of the compression member and the tension member, and a brake shoe disposed on each of the brake heads. The strut includes a strut body extending along a longitudinal axis between a proximal end and a distal end, the strut body including at least one slot defined in the strut body configured to receive and support a brake lever extending through the strut body non-parallel to the longitudinal axis of the strut body, a compression member engager connecting the strut body to the compression member, the compression member engager being connected to the distal end of the strut body, and a tension member engager engaging the tension member at the apex, the tension member engager being connected to the proximal end of the strut body. A first portion of the strut body at least partially defining the proximal end of the strut body and the distal end of the strut body is non-rotatably connected to the compression member engager and the tension member engager. A second portion of the strut body at least partially defining the at least one slot is rotatable about the longitudinal axis of the strut body with respect to the compression member engager and the tension member engager such that the at least one slot may be oriented at opposing angles with respect to a horizontal plane defined by the first and second ends of the compression member and the apex of the tension member.

According to yet another embodiment, a strut for a brake beam assembly is provided. The strut includes a strut body extending along a longitudinal axis between a proximal end and a distal end, the strut body including at least one slot defined in the strut body configured to receive and support a brake lever extending through the strut body non-parallel to the longitudinal axis of the strut body, a compression member engager configured to connect the strut body to a compression member of the brake beam assembly, the compression member engager being connected to the distal end of the strut body, at least one fastener configured to engage the compression member engager to fasten the compression member engager on the compression member, and a tension member engager configured to engage a tension member of the brake beam assembly, the tension member engager being connected to the proximal end of the strut body. At least a portion of the strut body is rotatable about the longitudinal axis of the strut body with respect to the compression member engager and the tension member engager such that the at least one slot may be oriented at opposing angles with respect to a horizontal plane extending through the longitudinal axis of the strut body.

According to still yet another particular embodiment, a method of changing the orientation of a strut of a brake beam assembly is provided. The method includes the steps of providing a strut, the strut including a strut body, the strut body extending along a longitudinal axis between a proximal end and a distal end and including an engagement member at the distal end and at least one slot defined in the strut body configured to receive and support a brake lever extending through the strut body non-parallel to the longitudinal axis of the strut body, wherein at least a portion of the strut body is rotatable about the longitudinal axis of the strut body; a compression member engager configured to connect the strut body to a compression member of the brake beam assembly, the compression member engager being connected to the engagement member at the distal end of the strut body; and a tension member engager configured to engage a tension member of the brake beam assembly, the tension member engager being connected to the proximal end of the strut body; and rotating the at least a portion of the strut body in a direction about the longitudinal axis of the strut body with respect to the compression member engager and the tension member engager to orient the slot at an angle with respect to a horizontal plane extending through the longitudinal axis of the strut body.

The method may further include the step of rotating the at least a portion of the strut body in an opposing direction about the longitudinal axis of the strut body with respect to the compression member engager and the tension member engager to orient the slot at a reverse angle with respect to the horizontal plane. The angle may be 40° in the direction about the longitudinal axis and the reverse angle may be 40° in the opposing direction about the longitudinal axis.

Further details and advantages of the various embodiments, detailed herein, will become clear upon reviewing the following detailed description of the preferred embodiments in conjunction with the accompanying drawing figures.

DESCRIPTION OF THE PREFERRED EMBODIMENTS

For purposes of the description hereinafter, spatial orientation terms, as used, shall relate to the referenced embodiment as it is oriented in the accompanying drawing figures or otherwise described in the following detailed description. However, it is to be understood that the embodiments described hereinafter may assume many alternative variations and configurations. It is also to be understood that the specific components, devices, and features illustrated in the accompanying drawing figures and described herein are simply exemplary and should not be considered as limiting.

The term "proximal" as used hereinafter throughout the description and in the claims is the direction along a longitudinal axis of the strut oriented toward the tension member of a brake beam assembly and the term "distal" as used hereinafter throughout the description and in the claims is the direction along the longitudinal axis of the strut oriented toward the compression member of the brake beam assembly.

Figure 1:
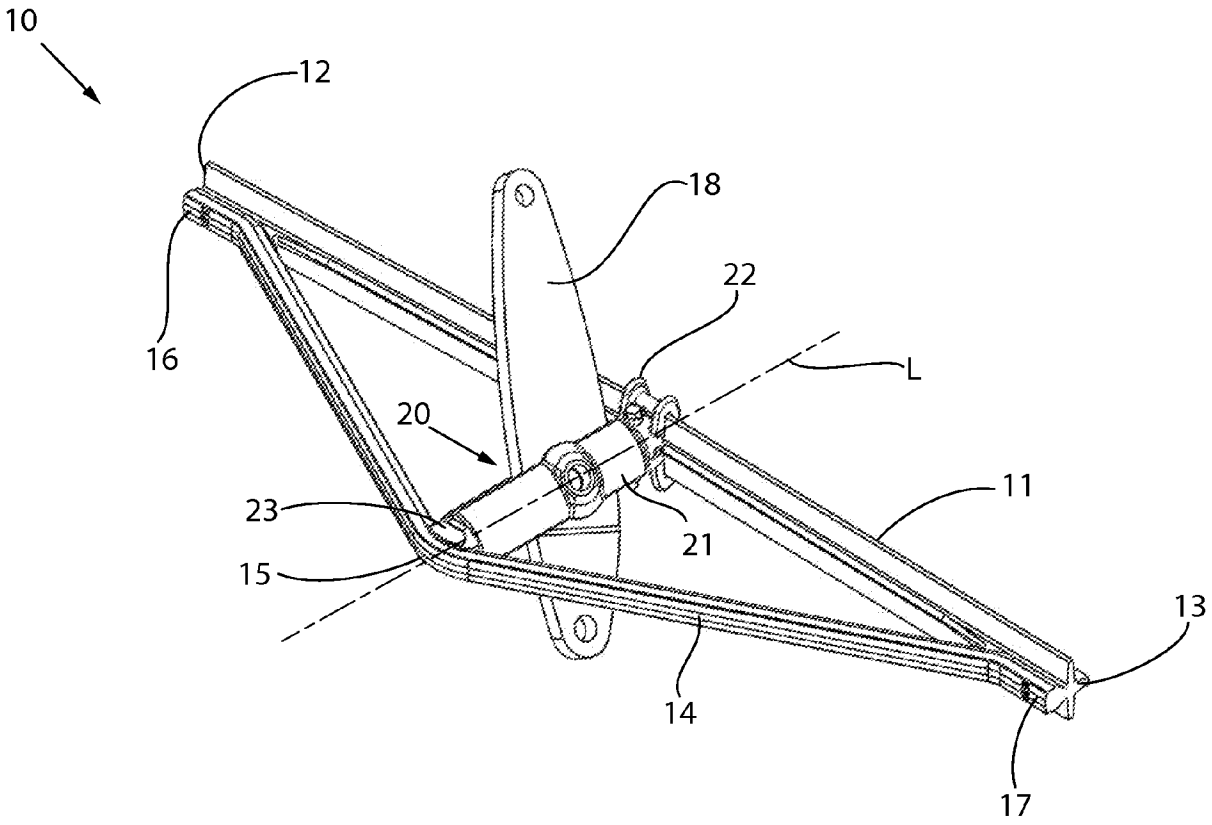
FIG. 1 is a perspective view of a portion of a brake beam assembly in a first configuration according to one embodiment.
Figure 2:
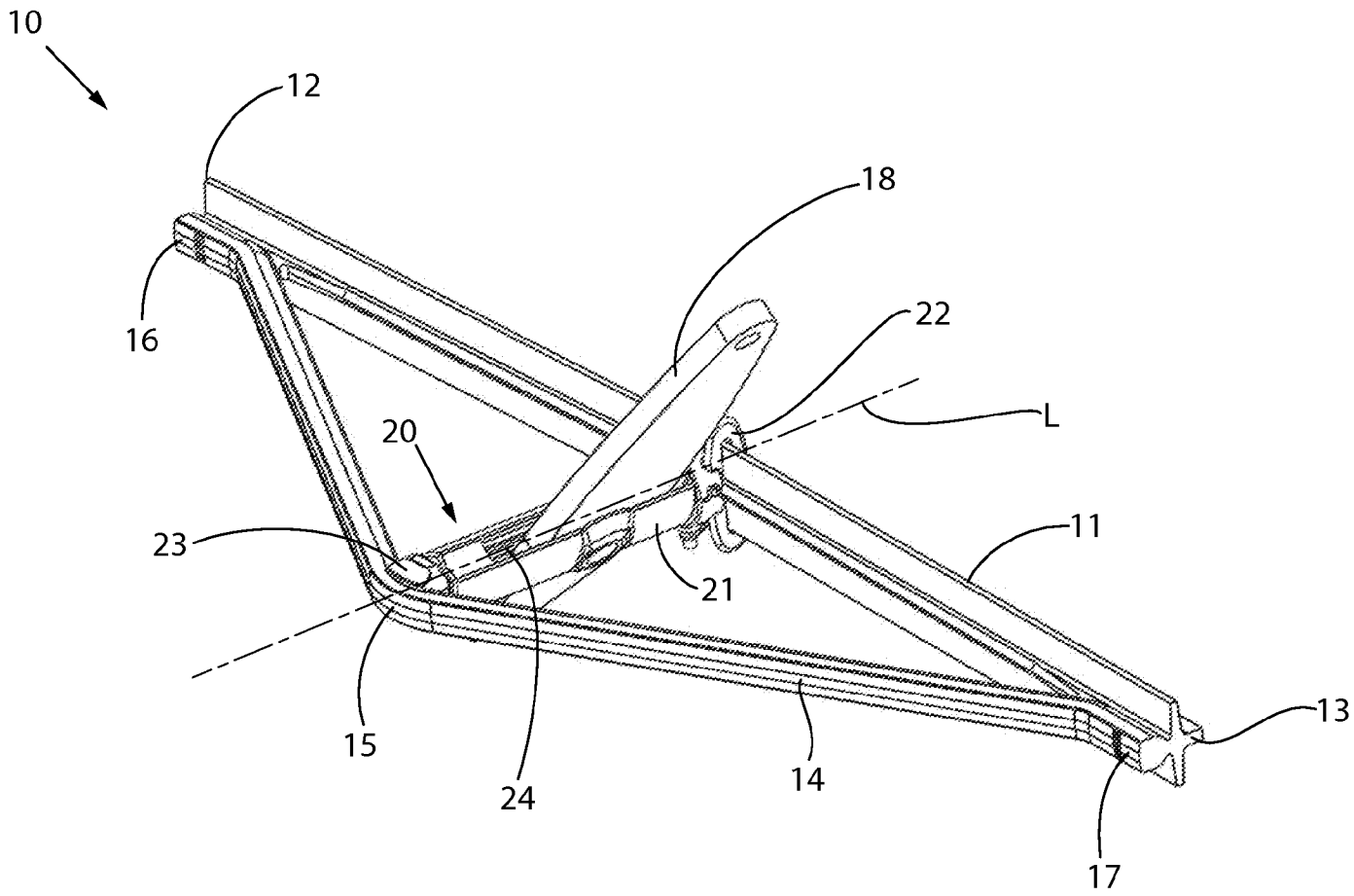
FIG. 2 is a perspective view of the portion of the brake beam assembly of FIG. 1 in a second configuration.
Figure 3:
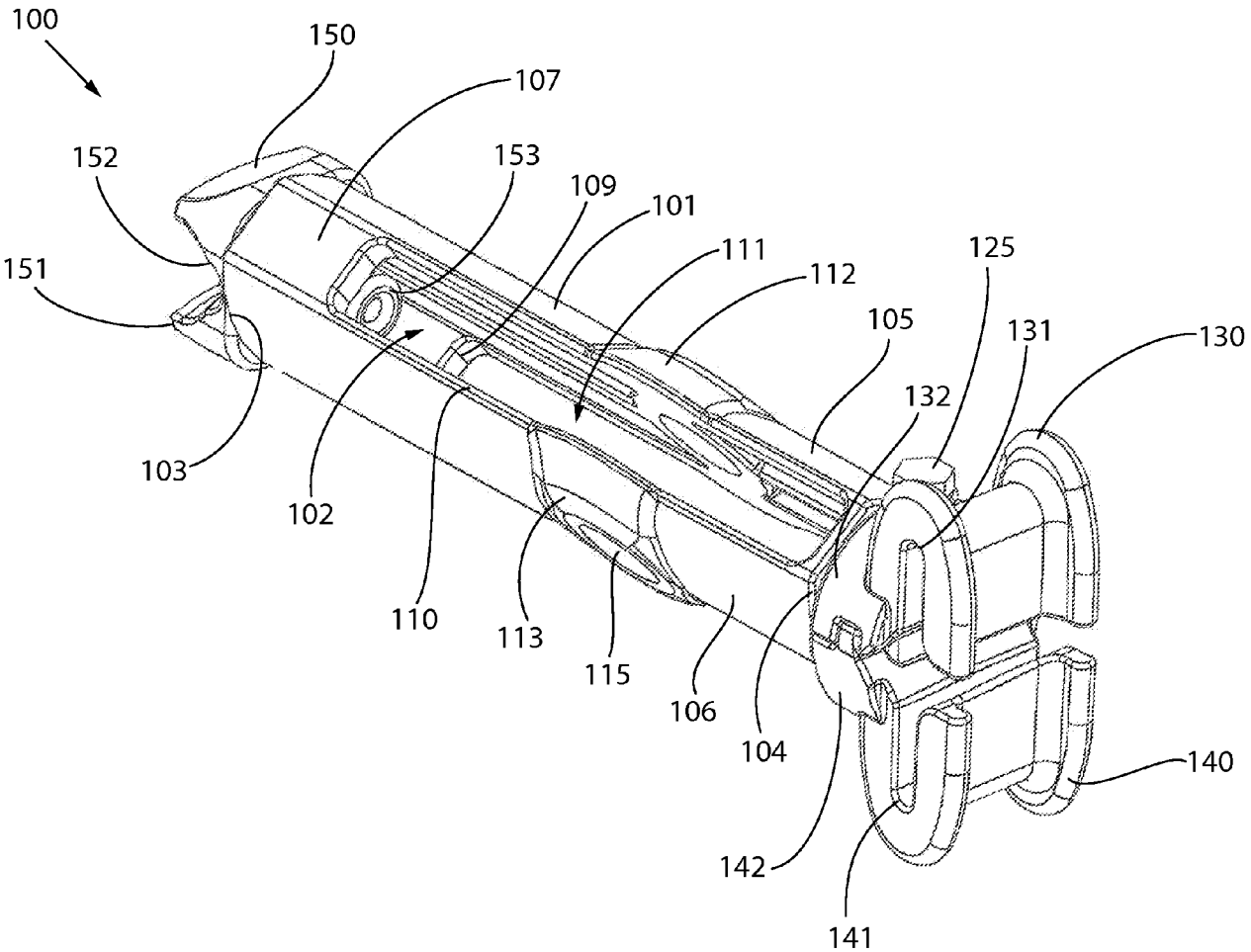
FIG. 3 is an upper distal perspective view of a strut for a brake beam assembly according to one embodiment.

With reference to FIGS. 1 and 2, a portion of a brake beam assembly 10 is shown according to one embodiment. The portion of the brake beam assembly 10 includes a compression member 11 having a first end 12 and a second end 13, and a tension member 14 having a first end 16, a second end 17, and a substantially V-shape defining an apex 15. The first end 16 and the second end 17 of the tension member 14 are connected to the first end 12 and the second end 13 of the compression member 11, respectively. A strut 20 extends between the compression member 11 and the apex 15 of the tension member 14. The strut 20 includes a strut body 21 that has a slot 24 defined therein that receives and supports a brake lever 18 of a brake actuator assembly, which extends through the strut body 21 non-parallel to a longitudinal axis L of the strut body 21. The strut 20 also includes a compression member engager 22 connected to the distal end of the strut body 21, which connects the strut body 21 to the compression member 11, and a tension member engager 23 connected to the proximal end of the strut body 21, which engages the tension member 14 at the apex 15. At least a portion of the strut body 21 is rotatable about the longitudinal axis L of the strut body 21 with respect to the compression member engager 22 and the tension member engager 23 such that the slot 24 may be oriented at opposing angles with respect to a horizontal plane defined by the first end 12 and the second end 13 of the compression member 11 and the apex 15 of the tension member 14, which bisects the compression member 11 and the tension member 14 at the ends 12, 13, 16, 17 and at the apex 15 of the tension member 14. Accordingly, the brake lever 18 retained within the slot 24 will also be oriented at one of the opposing angles such that the brake lever 18 can be positioned in a right-hand configuration or a left-hand configuration depending upon the need for one configuration or the other as a replacement part.

It is to be appreciated that, while not specifically illustrated, the portion of the brake beam assembly 10 shown in FIGS. 1 and 2 would also include a brake head directly or indirectly connected to each of the first ends 12, 16 and the second ends 13, 17 of the compression member 11 and the tension member 14 and a brake shoe disposed on each of the brake heads as is well known to those having ordinary skill in the art.

As shown in FIGS. 1 and 2, the portion of the strut body 21 is rotatable to orient the slot 24 at opposing angles of about 40° with respect to the horizontal plane defined by the ends 12, 13 of the compression member 11 and the apex 15 of the tension member 14. Accordingly, the portion of the strut body 21 is rotatable at least 80° about the longitudinal axis L of the strut body 21 such that the slot 24 can receive the brake lever 18 at one of the two opposing 40° angles with respect to the horizontal plane illustrated in FIGS. 1 and 2.

With reference to FIGS. 3-6, a strut 100, for use as the strut 20 in the assembly shown in FIGS. 1 and 2, is shown according to another embodiment. The strut 100 includes a strut body 101 extending along a longitudinal axis L between a proximal end 103 defined by a proximal wall and a distal end 104 defined by a distal wall. The strut body 101 has an internal cavity 102, which extends from the proximal end 103 to the distal end 104 of the strut body 101, defined therein by the inner surface of a wall of the strut body 101. Elongated openings 109, 110 are provided in respective lateral sides 107, 108 of the strut body 101. The elongated openings 109, 110 place the exterior of the strut body 101 in communication with the internal cavity 102 to define at least one slot 111, in particular a single slot 111, in the strut body 101, which is configured to receive and support a brake lever extending through the strut body 101 non-parallel to the longitudinal axis L of the strut body 101. Additionally, the strut body 101 includes an upper side 105 and a lower side 106. The upper side 105 and the lower side 106 each include a respective raised and contoured surface 112, 113. The raised and contoured surface 112 on the upper side 105 includes a hole 114 defined therein extending through the strut body 101 to the internal cavity 102. The raised and contoured surface 113 on the lower side 106 includes a hole 115 defined therein extending through the strut body 101 to the internal cavity 102. The holes 114, 115 are aligned to oppose each other and extend perpendicular to and intersect with the slot 111. The holes 114, 115 are configured to receive a fastener (not shown) that can be passed through the strut body 101 to connect and pivotably support a brake lever on the strut body 101 in the slot 111. The raised and contoured surfaces 112, 113 provide support for the fastener and increase the material strength of the strut body 101 at the location of the fastener.

The strut 100 also includes a compression member engager that includes a clamp made up of a first clamp member 130 and a second clamp member 140, which are configured to connect the strut body 101 to a compression member of the brake beam assembly, and a tension member engager 150, which is connected to the proximal end 103 of the strut body 101 and is configured to engage a tension member of the brake beam assembly.

Figure 4:
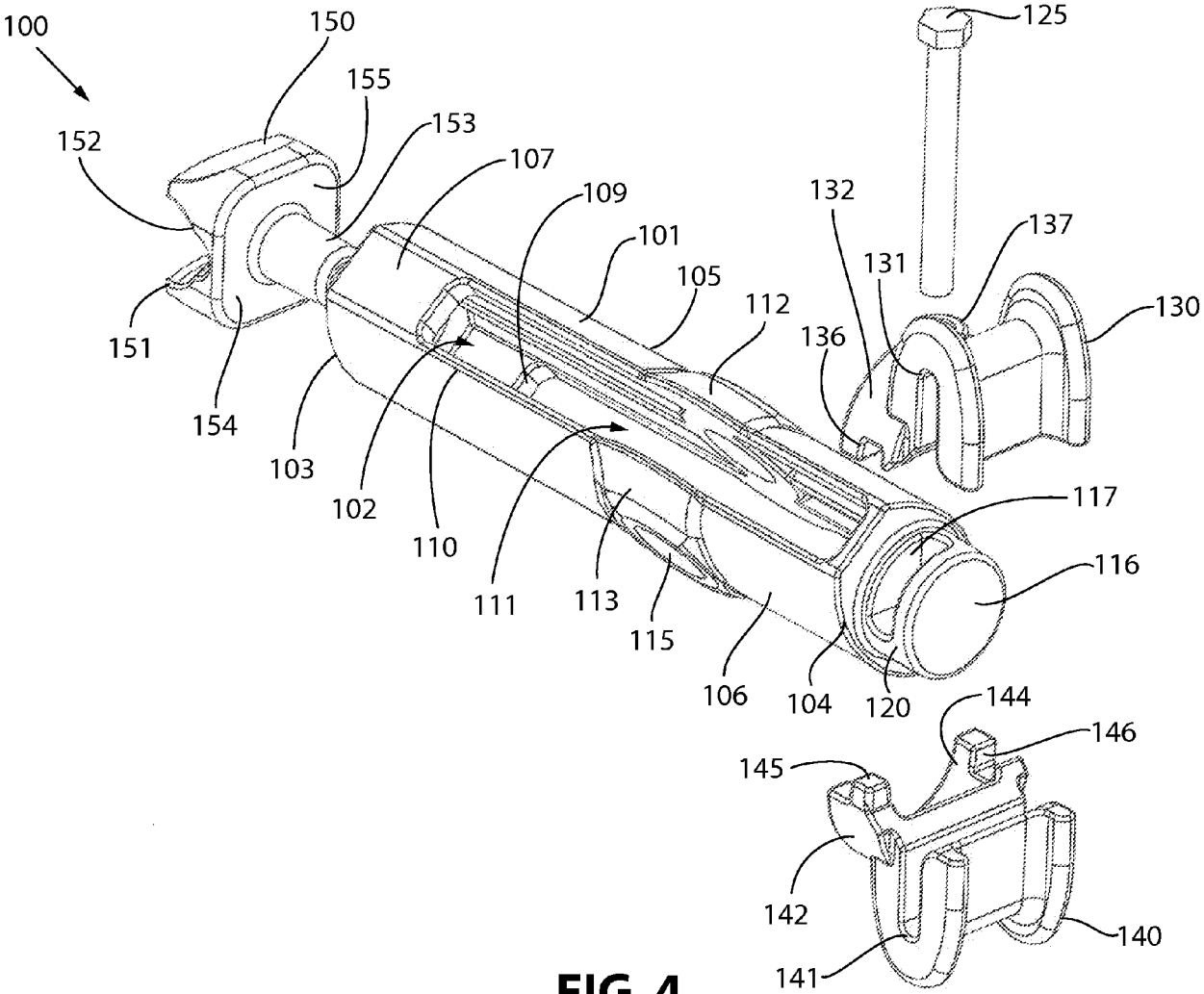
FIG. 4 is an exploded upper distal perspective view of the strut of FIG. 3.
Figure 5:
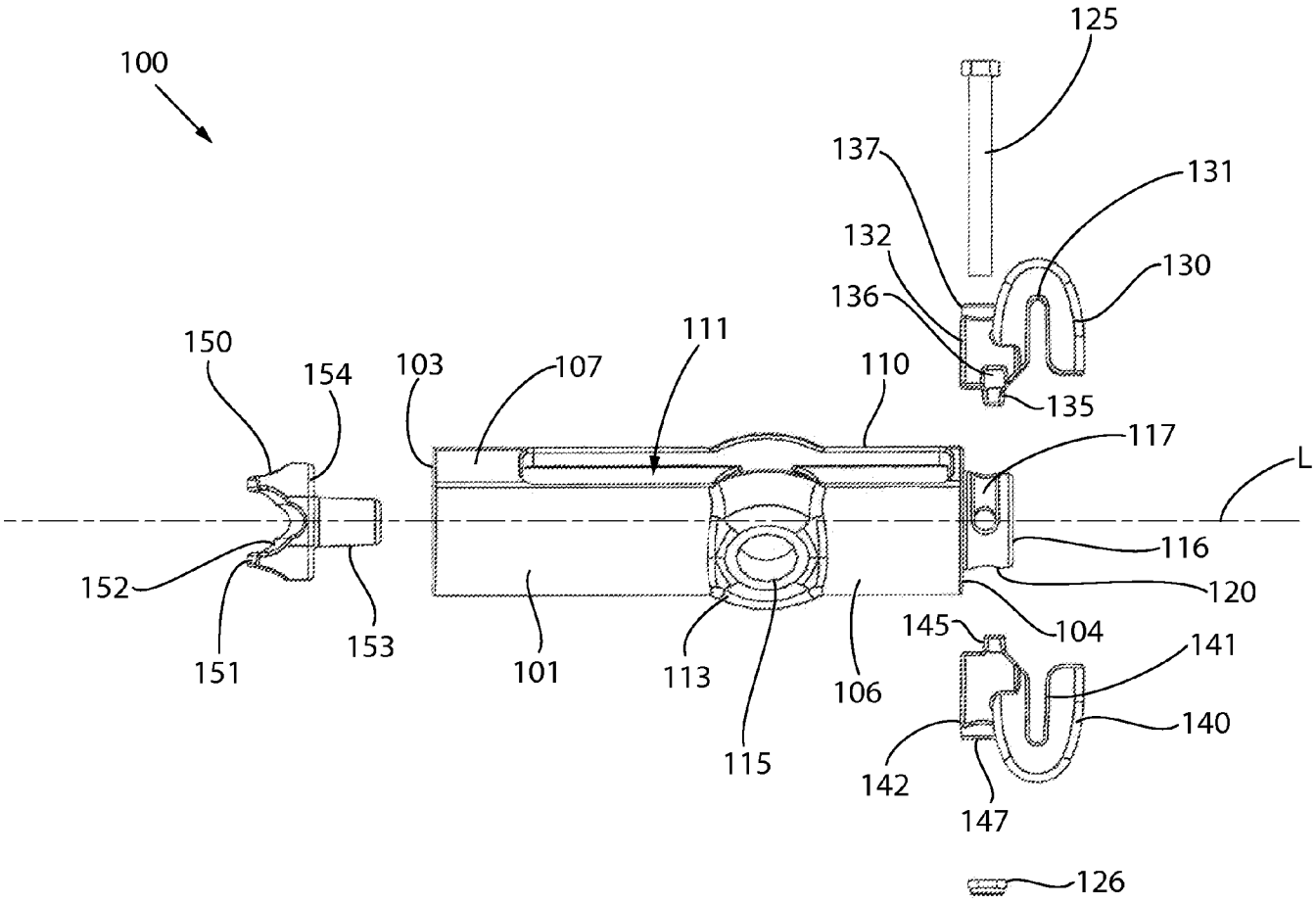
FIG. 5 is an exploded side view of the strut of FIG. 3.
Figure 6:
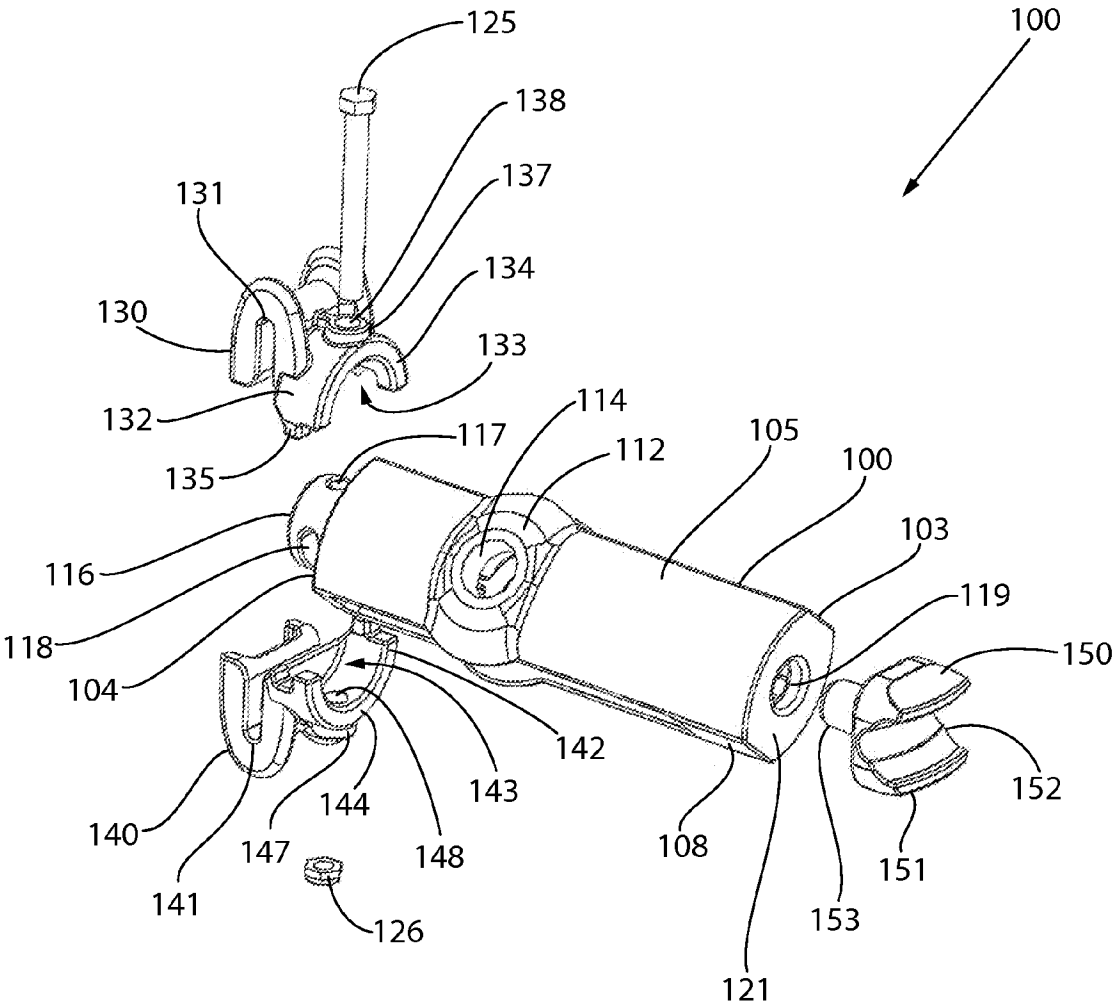
FIG. 6 is an exploded upper proximal perspective view of the strut of FIG. 3.
Figure 7:
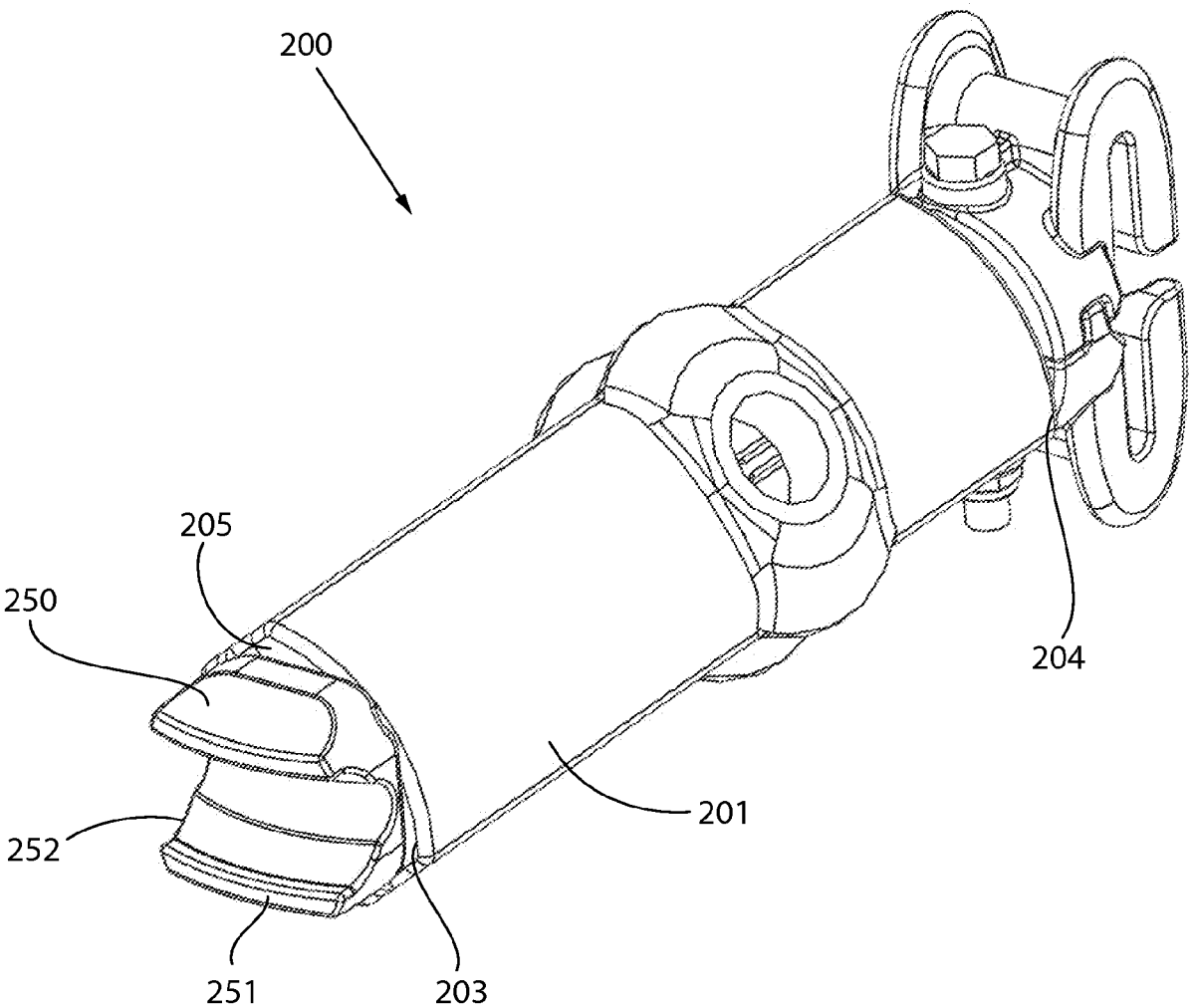
FIG. 7 is an upper proximal perspective view of a strut for a brake beam assembly according to another embodiment.

As shown in FIGS. 4-6, the strut body 101 includes an engagement member 116 positioned at the distal end 104 of the strut body 101. The engagement member 116 is provided to connect the clamp made up of the first clamp member 130 and the second clamp member 140 to the distal end 104 of the strut body 101. The engagement member 116 is a hollow cylindrical member defined by a cylindrical wall 120 extending from distal end 104 of the strut body 101. The engagement member 116 includes two opposing and elongated slots 117, 118, which are defined in the cylindrical wall 120 and extend circumferentially about the engagement member 116. The slots 117, 118 receive at least one fastener, which may include a bolt 125 and a nut 126, for removably connecting the clamp members 130, 140 to the engagement member 116 and the distal end 104 of the strut body 101. The at least one fastener 125, 126 also engages the clamp members 130, 140 to draw the clamp members 130, 140 together about the compression member 11 of the brake beam assembly 10, as shown in FIGS. 1 and 2, to non-rotatably fasten the clamp members 130, 140 on the compression member 11.

Each of the first clamp member 130 and the second clamp member 140 includes a respective U-shaped clamping portion 131, 141 for engaging the compression member of the brake beam assembly, and a respective connection portion 132, 142 for engaging the engagement member 116 of the strut body 101. Each connection portion 132, 142 of the clamp members 130, 140 includes a respective semi-circular wall 134, 144, which defines a respective semi-cylindrical recess 133, 143 that receives a portion of the engagement member 116 of the strut body 101 when the clamp members 130, 140 are attached to the strut body 101.

As shown in FIGS. 4-6, the opposing ends of the semi-circular walls 134, 144 of the clamp members 130, 140 are provided with complementary protrusions 135, 145 and recesses 136, 146, which fit together to provide a mating engagement between the semi-circular walls 134, 144 of the clamp members 130, 140. In particular, a protrusion 135 on one end of the semi-circular wall 134 of the first clamp member 130 fits within a corresponding recess 146 in an opposing end of the semi-circular wall 144 of the second clamp member 140. Likewise, a protrusion 145 on another end of the semi-circular wall 144 of the second clamp member 140 fits within a corresponding recess 136 in an opposing end of the semi-circular wall 134 of the first clamp member 130.

The outside surface of each of the semi-circular walls 134, 144 of the clamp members 130, 140 includes a respective boss portion 137, 147 that supports the fastener 125 extending through the clamp members 130, 140. Respective holes 138, 148 are defined in the boss portions 137, 147 and semi-circular walls 134, 144 of the clamp members 130, 140 for receiving the fastener 125 that connects the clamp members 130, 140 to the engagement member 116 of the strut body 101.

In particular, to connect the clamp members 130, 140 to the engagement member 116 of the strut body 101, the clamp members 130, 140 are fitted together over the engagement member 116 as discussed above and the fastener 125 is passed through the holes 138, 148 in the semi-circular walls 134, 144 of the clamp members 130, 140 and through the opposing slots 117, 118 of the hollow cylindrical member of the engagement member 116. Thus, when the clamp members 130, 140 are fastened together and to the engagement member 116, the strut body 101 is able to rotate about the longitudinal axis L with respect to the clamp members 130, 140. The amount that the strut body 101 is able to rotate about the longitudinal axis L is dependent upon the circumferential length of the slots 117, 118 in the cylindrical wall 120 of the engagement member 116, the ends of which act as stops for relative movement of the engagement member 116 with respect to the fastener 125 and, thus, the clamp members 130, 140. According to one embodiment, the slots 117, 118 are sized such that the strut body 101 is able to rotate approximately 80° about the longitudinal axis L with respect to the clamp members 130, 140.

As shown in FIGS. 3-6, the strut body 101 includes the proximal wall disposed at the proximal end 103 of the strut body 101, which defines a proximal end surface 121 of the strut body 101. An opening 119 is defined in the proximal wall. The tension member engager 150 includes an engagement portion 151 that has a channel 152 defined therein, which is configured to receive the tension member of the brake beam assembly. The engagement portion 151 also includes a distal wall 154 that defines a distal surface 155 of the engagement portion 151. A cylindrical stem 153 extends from the distal wall 154 of the engagement portion 151. The cylindrical stem 153 of the tension member engager 150 is received in the opening 119 in the proximal wall of the strut body 101. The cylindrical stem 153 is received within the opening 119 with a loose fit. Accordingly, the strut body 101 is freely rotatable with respect to the tension member engager 150. During use, the cylindrical stem 153 of the tension member engager 150 is inserted into the opening 119 such that the distal surface 155 of the distal wall 154 of the engagement portion 151 of the tension member engager 150 engages the proximal end surface 121 of the strut body 101. The tension member engager 150 is held against the strut body 101 by the tension member of the brake beam assembly.

As discussed above, the strut body 101 is connected to the clamp members 130, 140 and the tension member engager 150 to be rotatable about the longitudinal axis L of the strut body 101 with respect to the clamp members 130, 140 and the tension member engager 150. Accordingly, the slot 111 defined in the strut body 101 may be oriented at opposing angles with respect to a horizontal plane extending through the longitudinal axis L of the strut body 101. In particular, the slot 111 in the strut body 101 may be oriented at opposing angles of 40° with respect to the horizontal plane and the strut body 101 is rotatable for a total angle of at least 80° about the longitudinal axis L of the strut body 101.

With reference to FIGS. 7-10, a strut 200, for use as the strut 20 in the assembly shown in FIGS. 1 and 2, is shown in accordance with another embodiment. The strut 200 is identical to the strut 100 discussed above with respect to FIGS. 3-6, but for the engagement between a strut body 201 and a tension member engager 250. The strut 200 includes the strut body 201 extending along a longitudinal axis L between a proximal end 203 defined by a proximal wall and a distal end 204 defined by a distal wall. The strut body 201 includes the proximal wall disposed at the proximal end 203 of the strut body 201, which defines a proximal end surface 205 of the strut body 201. An opening 219 is defined in the proximal wall. The tension member engager 250 includes an engagement portion 251 that has a channel 252 defined therein, which is configured to receive the tension member of the brake beam assembly. The engagement portion 251 also includes a distal wall 254 that defines a distal surface 256 of the engagement portion 251. A cylindrical stem 253 extends from the distal wall 254 of the engagement portion 251. The cylindrical stem 253 of the tension member engager 250 is received in the opening 219 in the proximal wall of the strut body 201. The cylindrical stem 253 is received within the opening 219 with a loose fit. Accordingly, the strut body 201 is rotatable with respect to the tension member engager 250.

Figure 8:
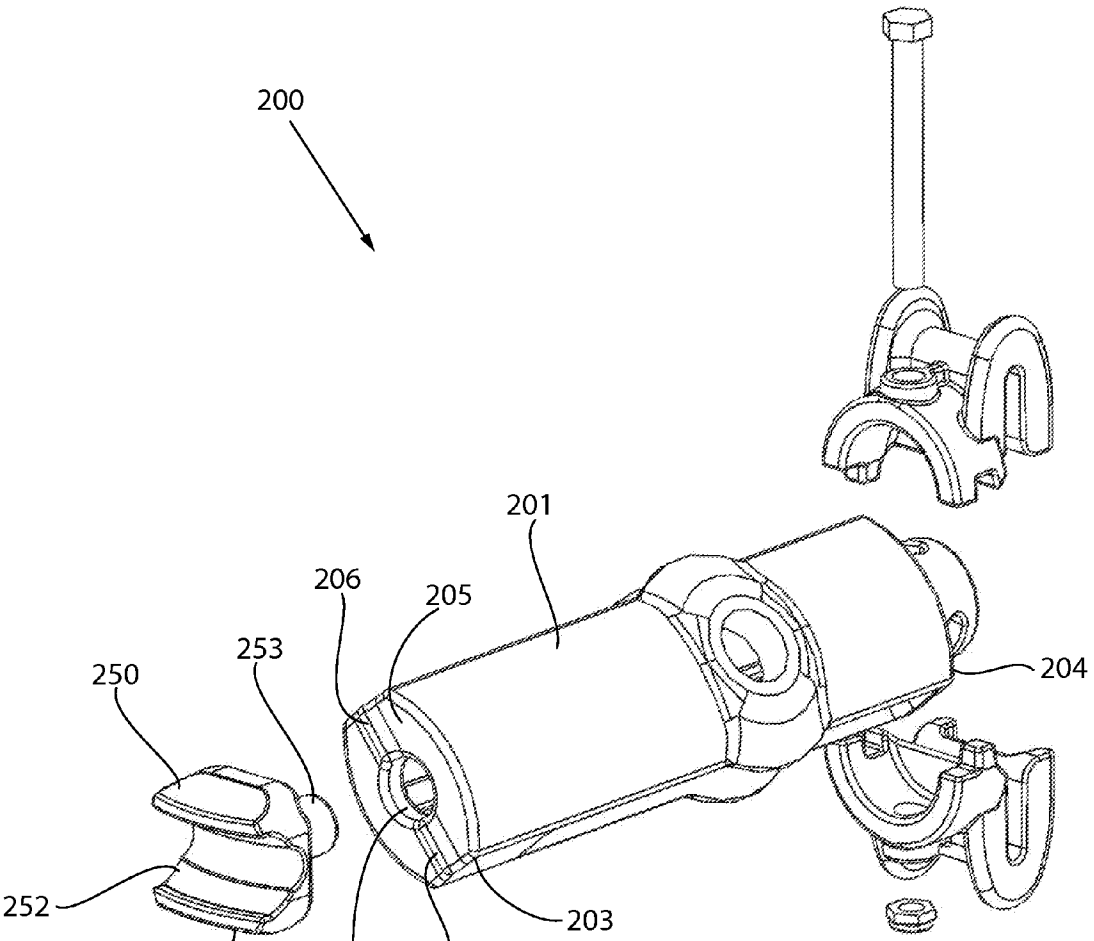
FIG. 8 is an exploded upper proximal perspective view of the strut of FIG. 7.
Figure 9:
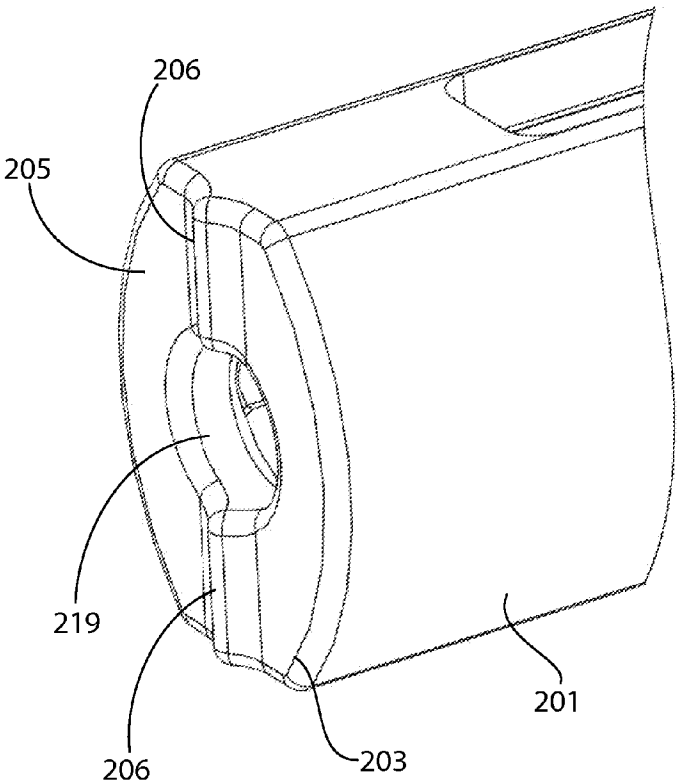
FIG. 9 is a detailed exploded proximal perspective view of the strut of FIG. 7.
Figure 9:
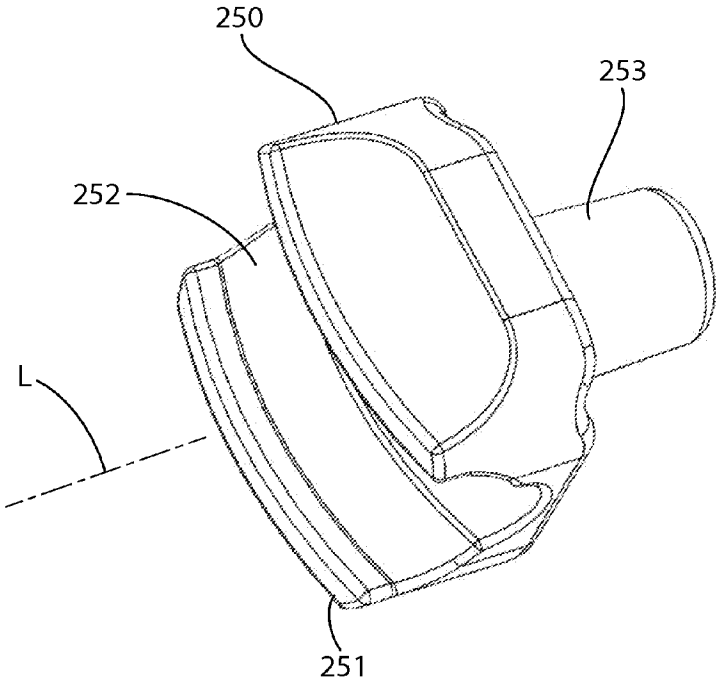
Figure 10:
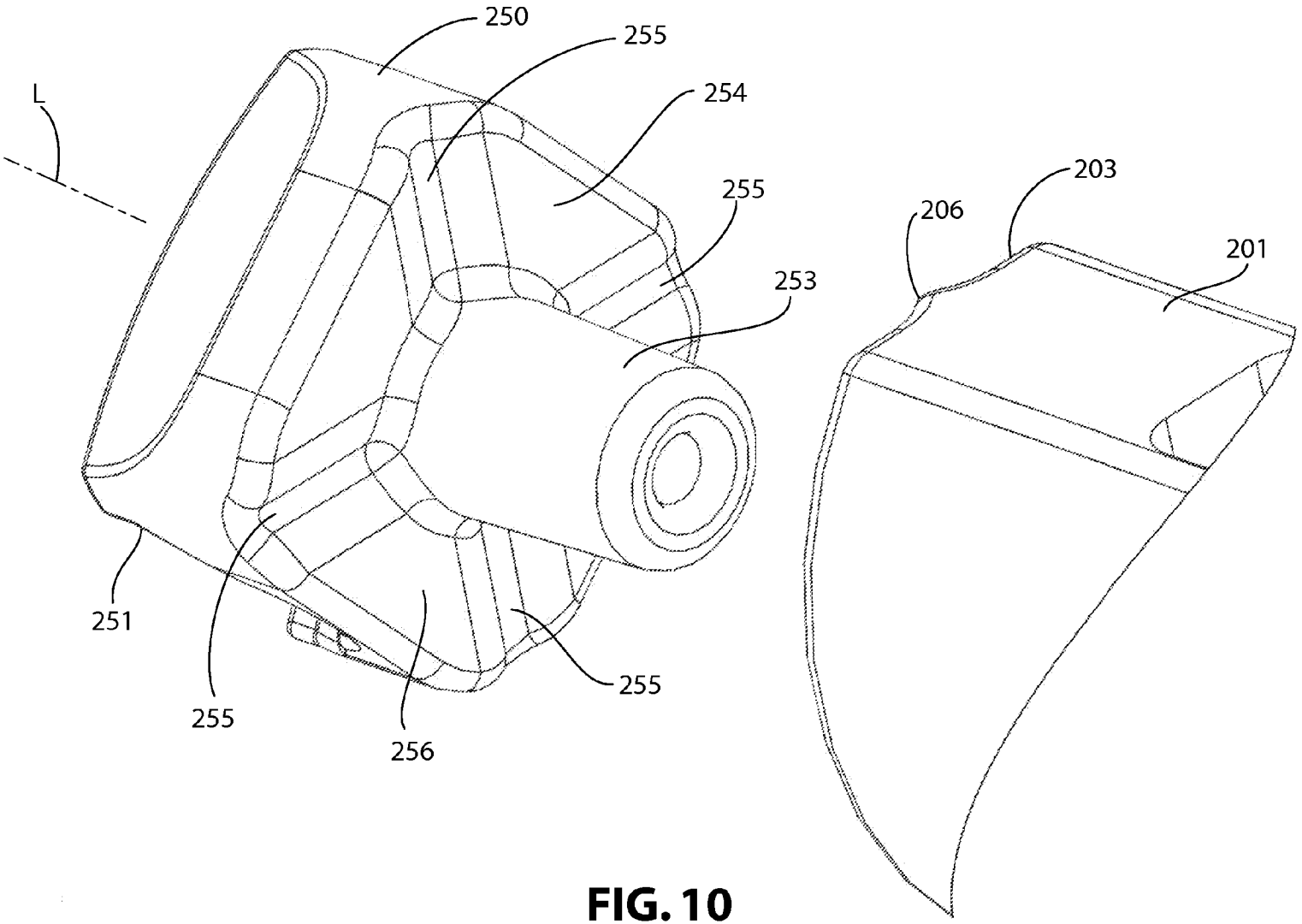
FIG. 10 is a detailed exploded distal perspective view of the strut of FIG. 7.

Further, as shown in FIGS. 8-10, the proximal end surface 205 of the proximal wall of the strut body 201 includes at least one key protrusion 206 extending across the proximal end surface 205 on at least one side of the opening 219. In particular, the at least one key protrusion 206 includes two key protrusions 206 extending across the proximal end surface 205 on both sides of the opening 219. The distal surface 256 of the distal wall 254 of the engagement portion 251 of the tension member engager 250 includes at least one key groove 255. In particular, the at least one key groove 255 includes a plurality of key grooves 255. The key grooves 255 have a shape complementary to the shape of the key protrusions 206 on the proximal end surface 205 of the strut body 201. During use, the cylindrical stem 253 of the tension member engager 250 is inserted into the opening 219 such that the distal surface 256 of the distal wall 254 of the engagement portion 251 of the tension member engager 250 engages the proximal end surface 205 of the strut body 201. The tension member engager 250 is held against the strut body 201 by the tension member of the brake beam assembly. The key protrusions 206 engage the key grooves 255 to prevent rotation of the strut body 201 with respect to the tension member engager 250 when the proximal end surface 205 of the strut body 201 and the distal surface 256 of the engagement portion 251 of the tension member engager 250 are abutting. The key grooves 255 are appropriately angled with respect to the key protrusions 206 so that the strut body 201 is retained in position with the slot aligned in one of the opposing 40° angles. In order to rotate the strut body 201 when the strut 200 is assembled in the brake beam assembly, the strut body 201 is pulled or levered apart from the tension member engager 250 and the strut body 201 can be rotated until the key protrusions 206 re-engage a different set of key grooves 255 at an opposing orientation of the strut body 201.

Figure 11:
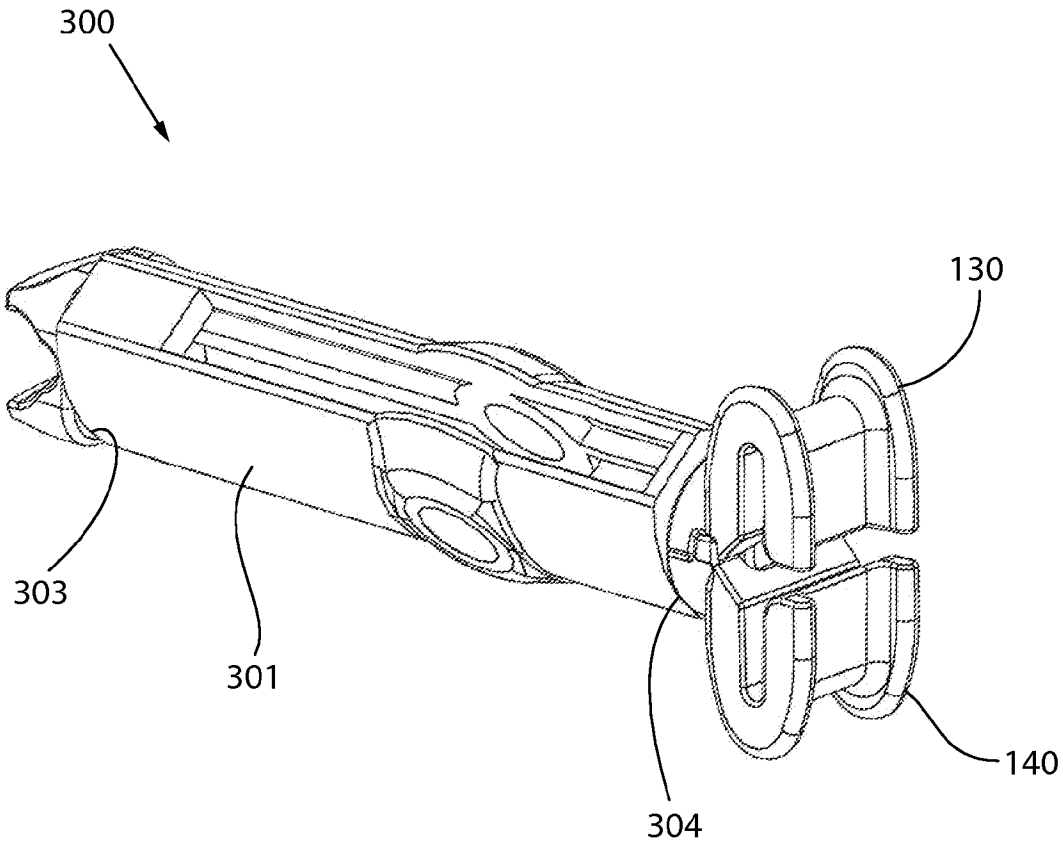
FIG. 11 is an upper distal perspective view of a strut for a brake beam assembly according to another embodiment.
Figure 12:
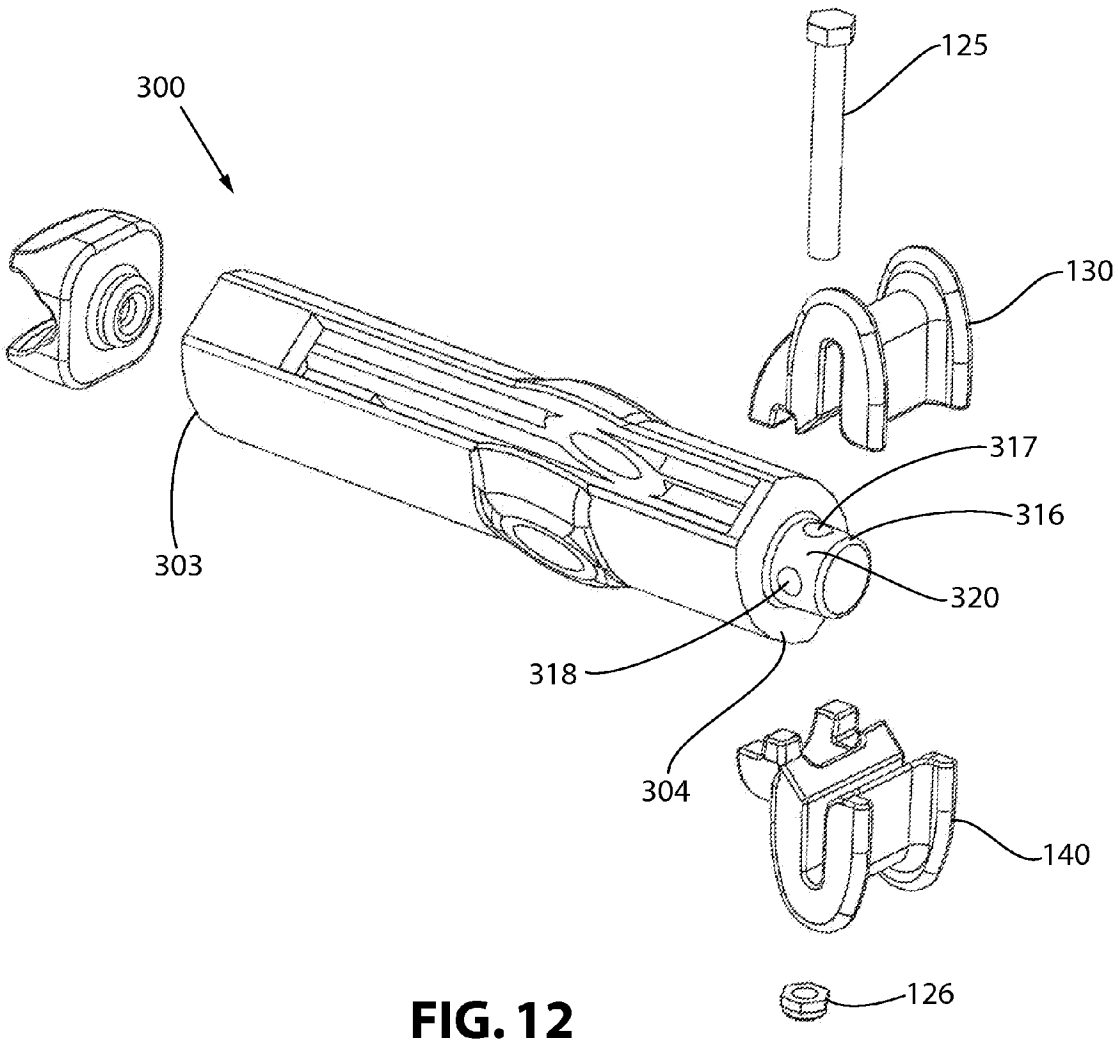
FIG. 12 is an exploded upper distal perspective view of the strut of FIG. 11.
Figure 13:
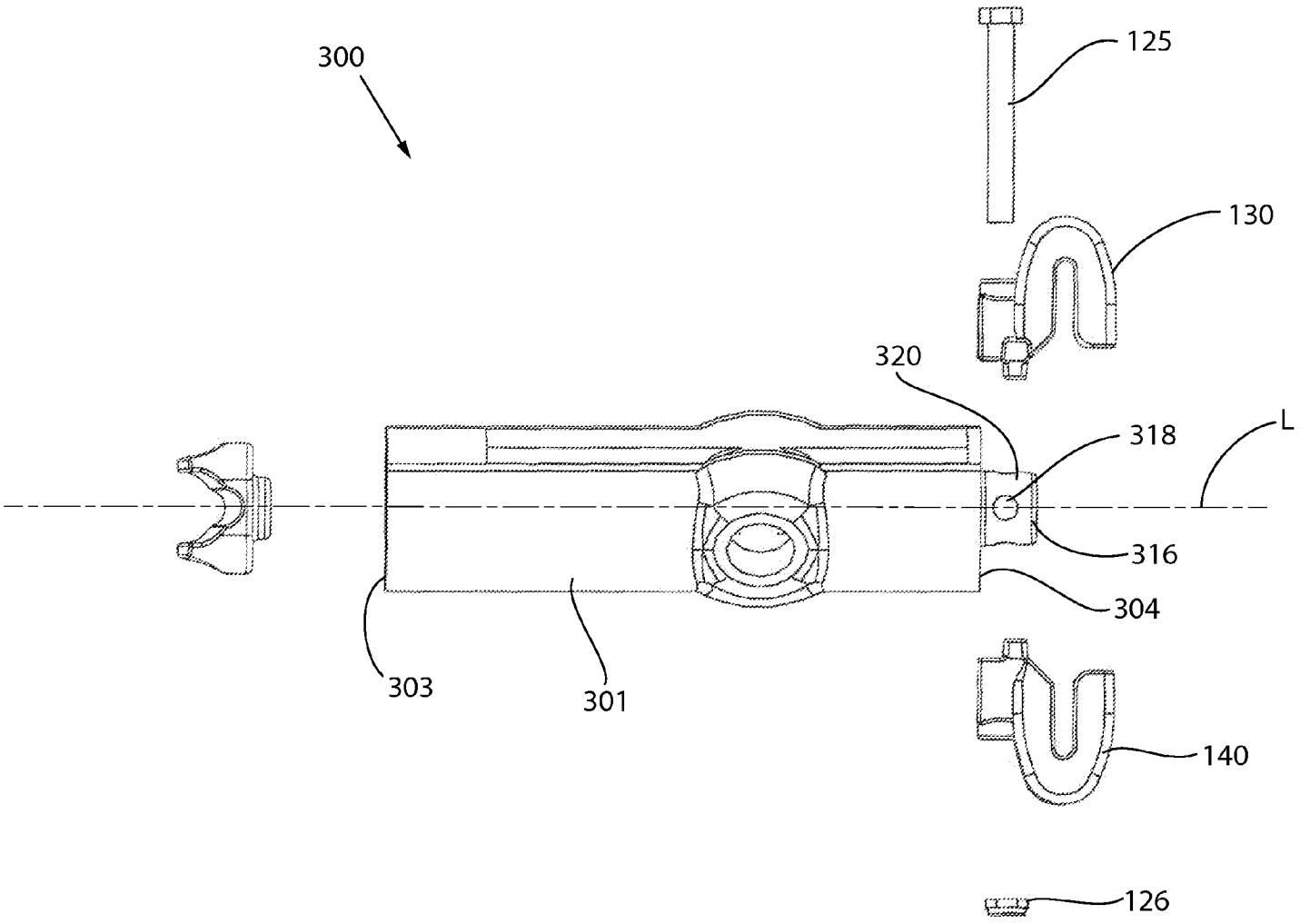
FIG. 13 is an exploded side view of the strut of FIG. 11.
Figure 14:
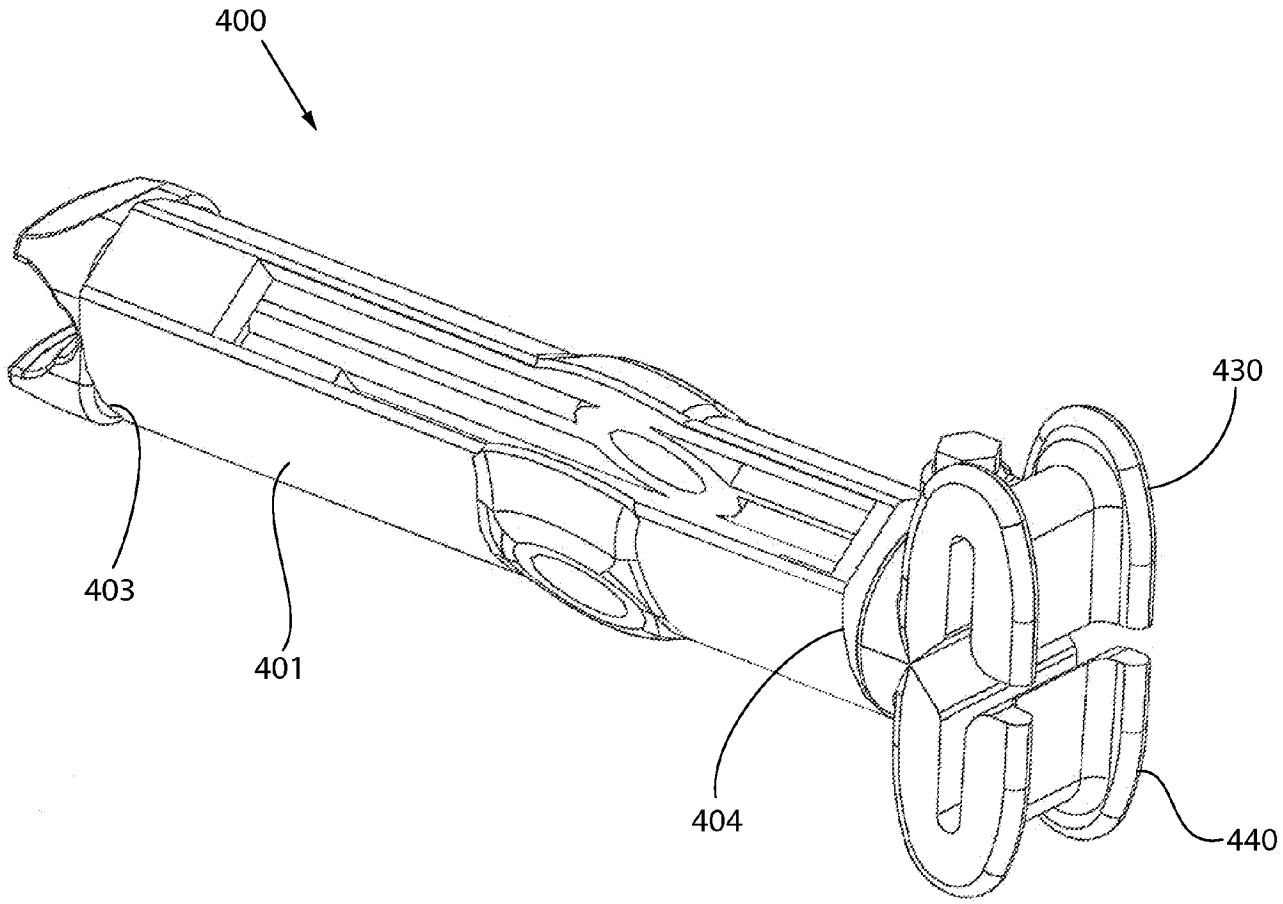
FIG. 14 is an upper distal perspective view of a strut for a brake beam assembly according to another embodiment.
Figure 15:
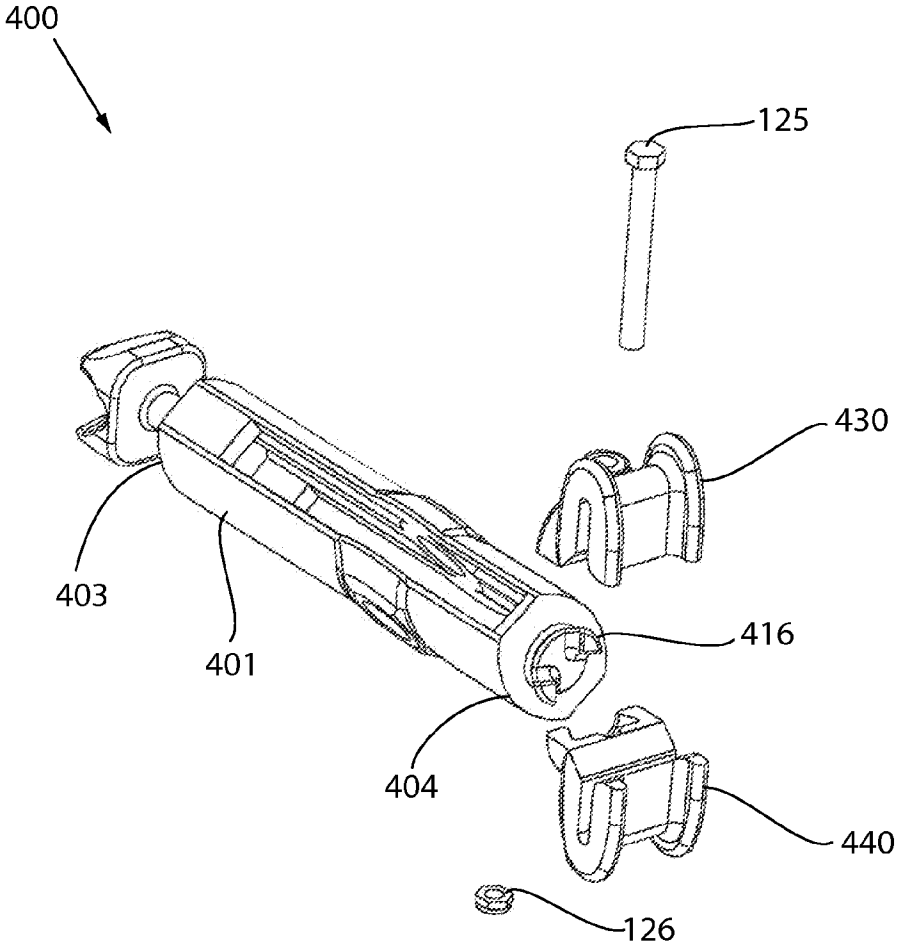
FIG. 15 is an exploded upper distal perspective view of the strut of FIG. 14.
Figure 16:
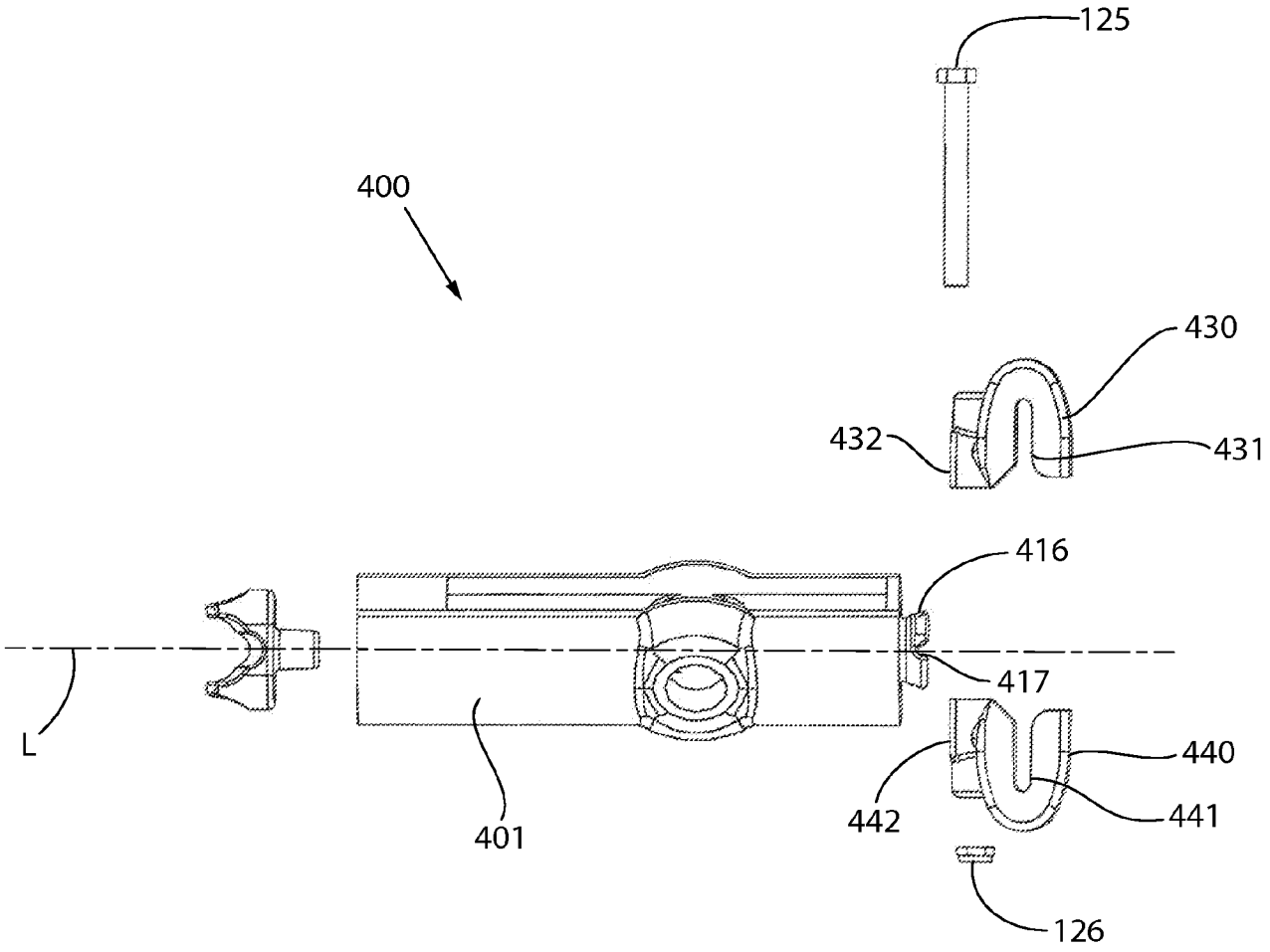
FIG. 16 is an exploded side view of the strut of FIG. 14.

With reference to FIGS. 11-13, a strut 300, for use as the strut 20 in the assembly shown in FIGS. 1 and 2, is shown in accordance with another embodiment. The strut 300 is identical to the strut 100 discussed above with respect to FIGS. 3-6, but for the configuration of the apertures in an engagement member 316. The strut 300 includes a strut body 301 extending along a longitudinal axis L between a proximal end 303 defined by a proximal wall and a distal end 304 defined by a distal wall. The engagement member 316 is a hollow cylindrical member that includes a cylindrical wall 320 having two pairs of opposing holes 317, 318 defined therein for receiving the fastener 125. The clamp members 130, 140 are secured to the engagement member 316 of the strut body 301 and fastened on the compression member 11 of the brake beam assembly 10 (shown in FIGS. 1 and 2) by passing the fastener 125 through the clamp members 130, 140 and through one of the pairs of opposing holes 317, 318, which align the strut body 301 at one of the opposing angles with respect to the horizontal plane described above with reference to FIGS. 1 and 2. In order to change the configuration of the strut body 301, the fastener 125 is removed from the clamp members 130, 140 and the engagement member 316; the strut body 301 and the engagement member 316 are rotated such that a different pair of opposing holes 317, 318 is aligned with the clamp members 130, 140; and the fastener 125 is replaced to secure the clamp members 130, 140 to the engagement member 316.

Figure 17:
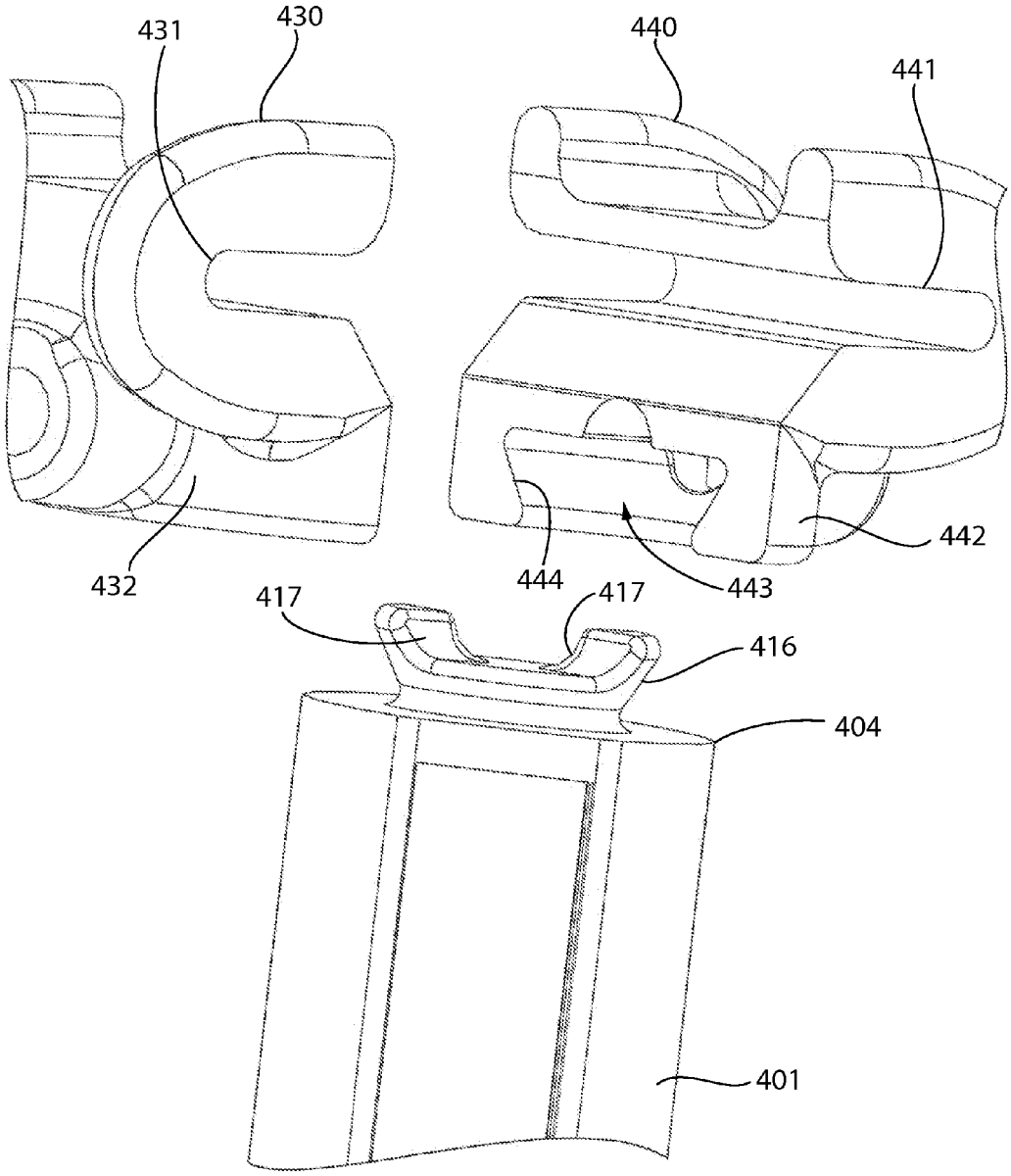
FIG. 17 is a detailed exploded distal perspective view of the strut of FIG. 14.
Figure 18:
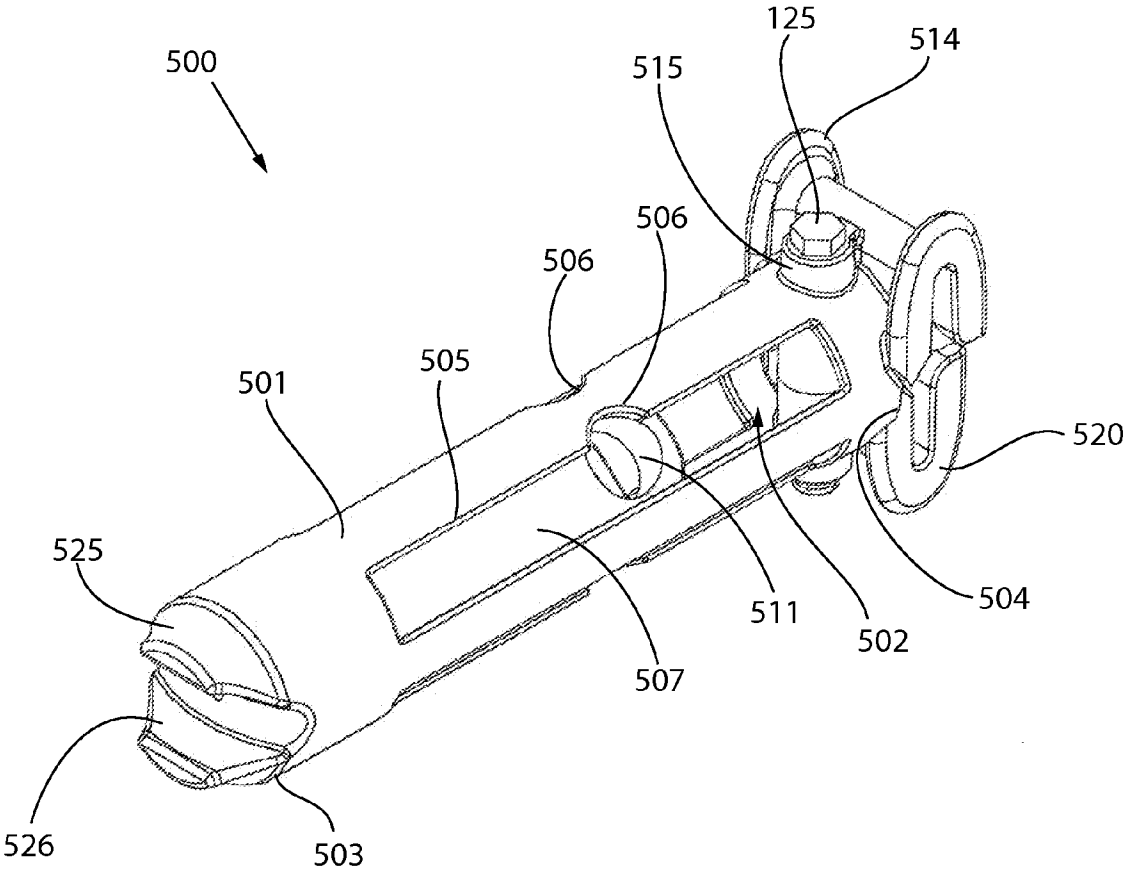
FIG. 18 is an upper proximal perspective view of a strut for a brake beam assembly according to another embodiment.

With reference to FIGS. 14-17, a strut 400, for use as the strut 20 in the assembly shown in FIGS. 1 and 2, is shown in accordance with another embodiment. The strut 400 is identical to the strut 100 discussed above with respect to FIGS. 3-6, but for the configuration of an engagement member 416 and clamp members 430, 440. The strut 400 includes a strut body 401 extending along a longitudinal axis L between a proximal end 403 defined by a proximal wall and a distal end 404 defined by a distal wall. The clamp members 430, 440 each include a respective U-shaped clamping portion 431, 441 and a respective semi-circular connection portion 432, 442 that engages the engagement member 416 of the strut body 401. As shown in FIG. 17, a semi-circular wall 444 of the connection portion 442 of the second clamp member 440 is inwardly inclined such that a semi-cylindrical recess 443 has a dove-tail shape. It is to be appreciated that, though not shown, the first clamp member 430 has a similar configuration of inwardly inclined semi-circular wall and dove-tail shaped recess as the second clamp member 440, shown in FIG. 17. The engagement member 416 of the strut body 401 is a dove-tail shaped member inclined outwardly from the distal end 404 of the strut body 401 to form a mating engagement with the connection portion 432, 442 of each of the clamp members 430, 440. A wall of the engagement member 416 is cut-away at opposing positions of the engagement member 416 to form slots 417 for receiving the fastener 125 for securing the clamp members 430, 440 to the engagement member 416. The slots 417 may be provided with a circumferential length to define an 80° arc that allows the strut body 401 to rotate about the longitudinal axis L with respect to the clamp members 430, 440 between the opposing angles.

With reference to FIGS. 18-21, a strut 500, for use as the strut 20 in the assembly shown in FIGS. 1 and 2, is shown in accordance with another embodiment. The strut 500 includes a strut body 501 extending along a longitudinal axis L between a proximal end 503 and a distal end 504. The strut body 501 includes an internal wall defining an internal cavity 502 extending longitudinally through the strut body 501 from the proximal end 503 of the strut body 501 to the distal end 504 of the strut body 501. Two pairs of opposing elongated openings 505 extend through the strut body 501 from the internal wall to an exterior of the strut body 501 to place the internal cavity 502 in communication with the exterior of the strut body 501. The openings 505 each include an arcuate notch 506 to allow a fastener 125 to extend through the openings 505 for securing a brake lever to the strut 500. The strut body 501 includes a first stationary portion that is non-rotatably connected to a compression member engager 514, 520 and a tension member engager 525. The first stationary portion includes the internal wall defining the internal cavity 502 and at least partially defines the proximal end 503 and the distal end 504 of the strut body 501.

The strut body 501 also includes a second portion, which includes a strut insert 507 that is slidably and rotatably disposed within the internal cavity 502 of the strut body 501. The strut insert 507 is a U-shaped member defined by a proximal wall 508 and two upstanding cylindrical sidewalls 509, 510 that conform to the shape of the internal cavity 502 of the strut body 501. The sidewalls 509, 510 are spaced apart to define a separation 513 in the strut insert 507 that is configured to receive and support the brake lever. Openings 511, 512 are defined in each of the respective sidewalls 509, 510 near the distal end of the strut insert 507 for receiving the fastener pivotably supporting the brake lever on the strut 500. The strut insert 507 is rotatably received in the internal cavity 502 with the proximal wall 508 of the strut insert 507 positioned at the proximal end 503 of the strut body 501. The strut insert 507 is rotated within the internal cavity 502 of the strut body 501 to align the separation 513 with one of the pairs of opposing elongated openings 505 to form a slot for receiving and supporting the brake lever. In particular, the openings 505 in the strut body 501 are positioned to align the brake lever at one of the two opposing 40° angles. The fastener is extended through the other of the pair of openings 505 not defining the slot and the openings 511, 512 in the strut insert 507.

As shown in FIGS. 18-21, the compression member engager of the strut 500 includes a clamp assembly engaging the compression member 11 of the brake beam assembly 10 (shown in FIGS. 1 and 2). The clamp assembly includes a first U-shaped clamp member 514 fixedly disposed on the distal end 504 of the strut body 501, which is configured to engage the compression member of the brake beam assembly. A raised protrusion 515 is provided adjacent to the clamp member 514 and includes a hole 516 defined therein for receiving and supporting the fastener 125 extending through the strut body 501. A recess 517 for receiving a second clamp member 520 of the clamp assembly is also defined in the distal end 504 of the strut body 501 alongside the clamp member 514.

Figure 19:
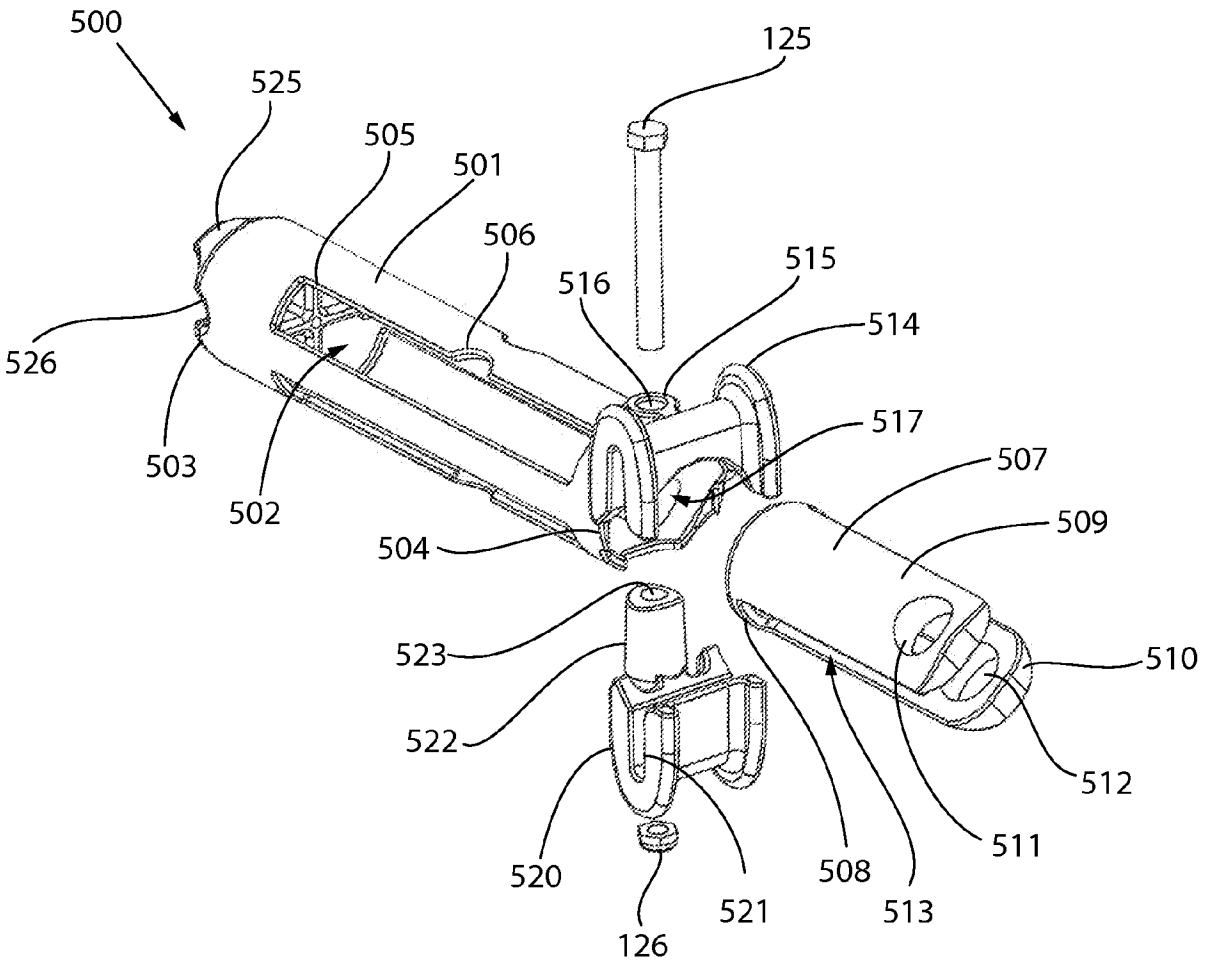
FIG. 19 is an exploded upper distal perspective view of the strut of FIG. 18.
Figure 20:
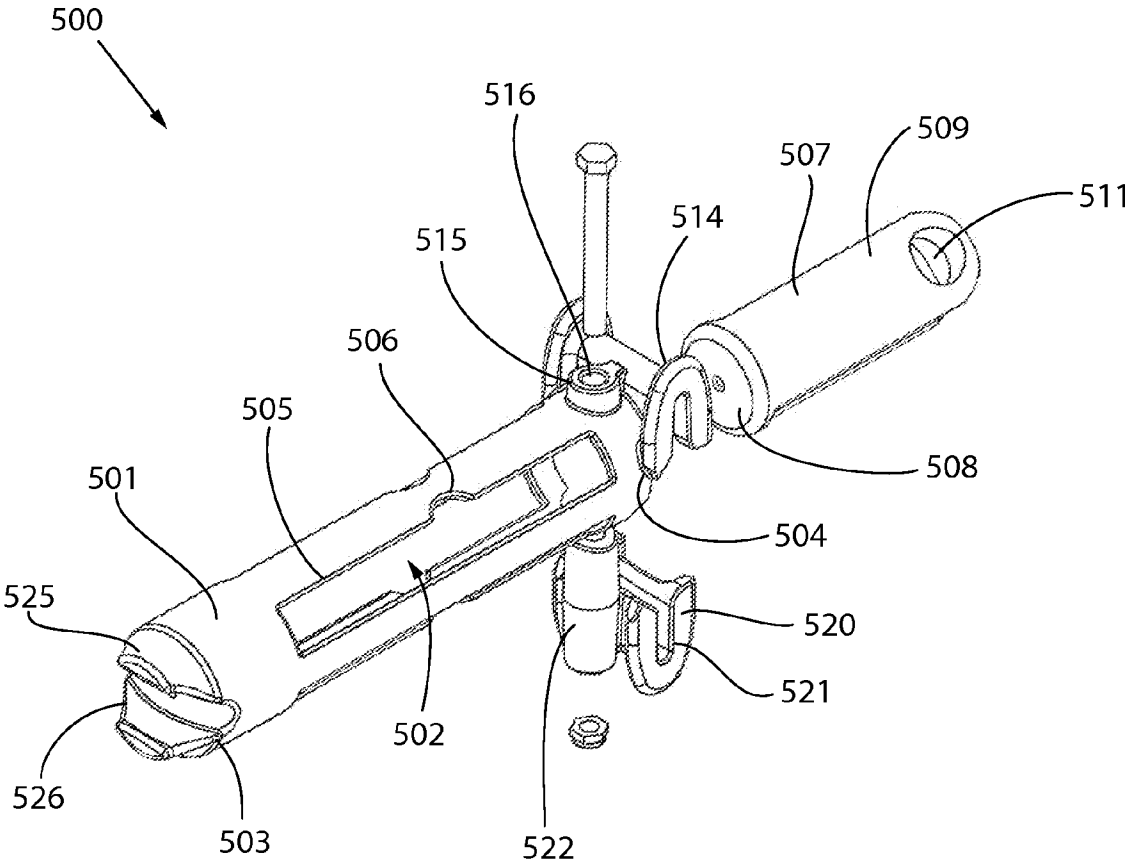
FIG. 20 is an exploded upper proximal perspective view of the strut of FIG. 18.
Figure 21:
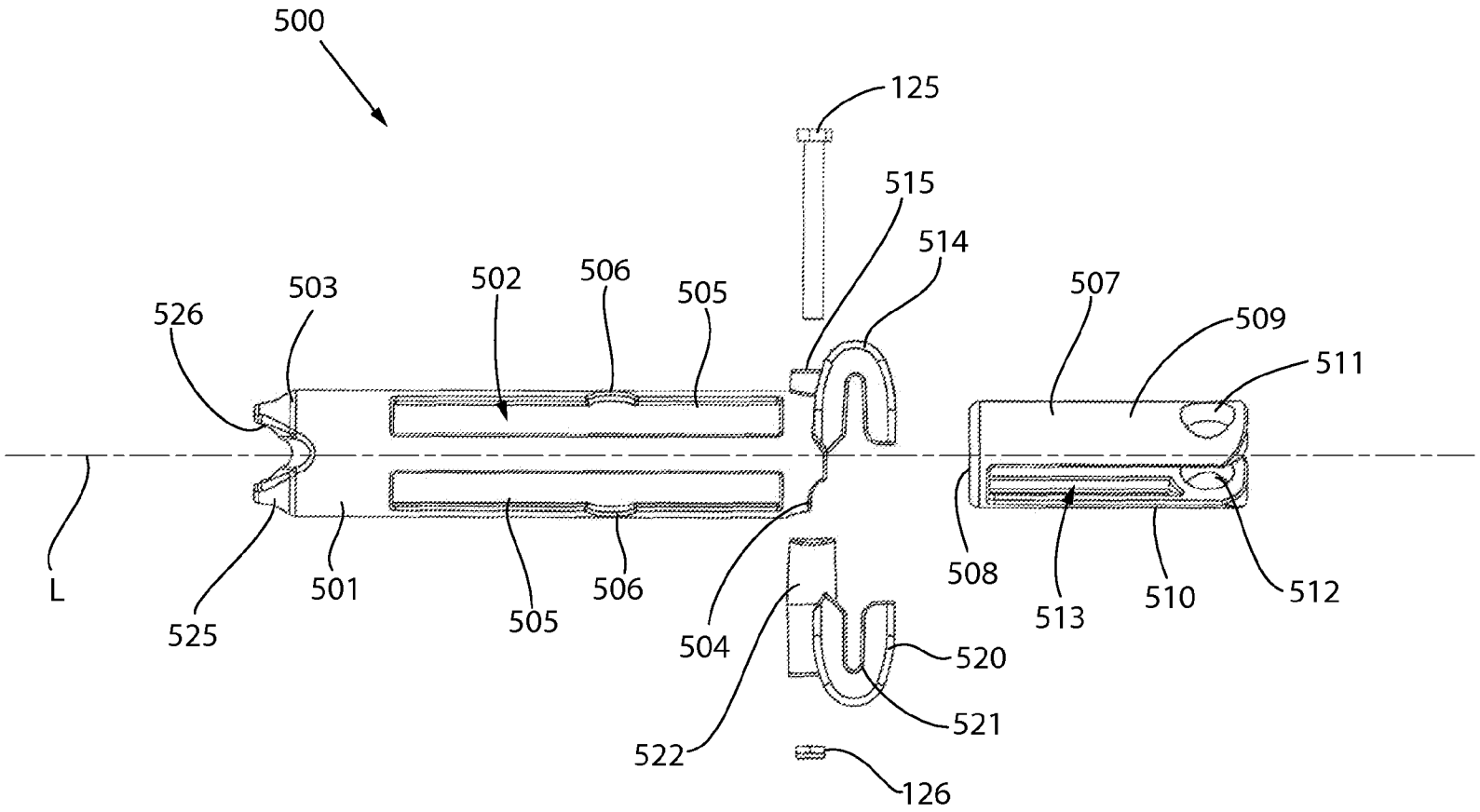
FIG. 21 is an exploded side view of the strut of FIG. 18.

As shown in FIGS. 19-21, the second clamp member 520 includes a U-shaped clamping portion 521 configured to engage the compression member of the brake beam assembly. The second clamp member 520 also includes a cylindrical connection portion 522 that engages with the recess 517 in the distal end 504 of the strut body 501. The cylindrical connection portion 522 also includes a hole 523 defined therein for receiving the fastener 125. Accordingly, the second clamp member 520 is removably secured to the distal end 504 of the strut body 501 by the fastener 125, 126, such that the clamping portion 521 of the second clamp member 520 is aligned with the first clamp member 514 of the clamp assembly and the clamping portion 521 cooperates with the first clamp member 514 to secure the strut 500 to the compression member of the brake beam assembly. The fastener 125, 126 also non-rotatably fastens the first and second clamp members 514, 520 on the compression member by drawing them together about the compression member.

Further, as shown in FIGS. 18-21, the tension member engager 525 of the strut 500 is integrally formed in the proximal end 503 of the strut body 501. The tension member engager 525 has a channel 526 defined therein configured to receive the tension member of the brake beam assembly.

Figure 22:
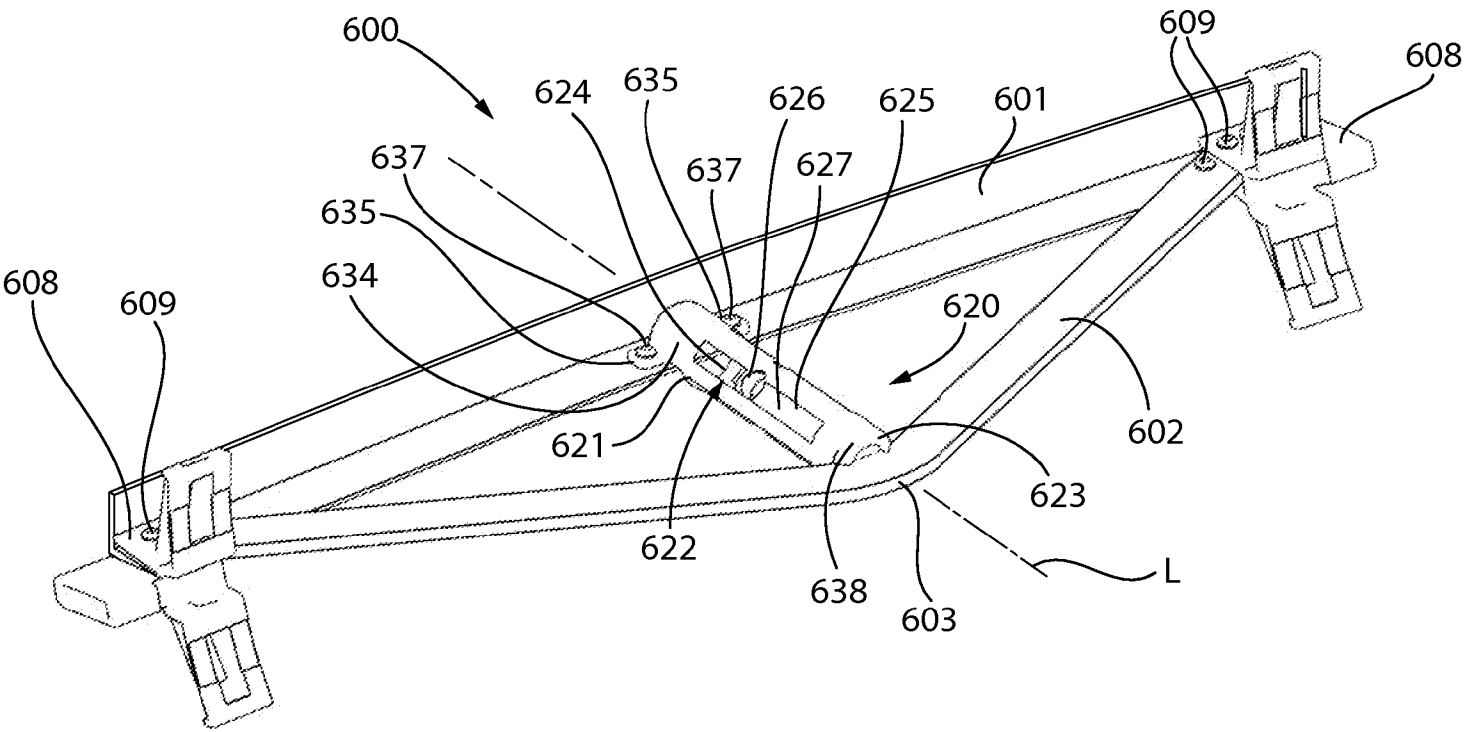
FIG. 22 is a first perspective view of a brake beam assembly according to another embodiment.
Figure 23:
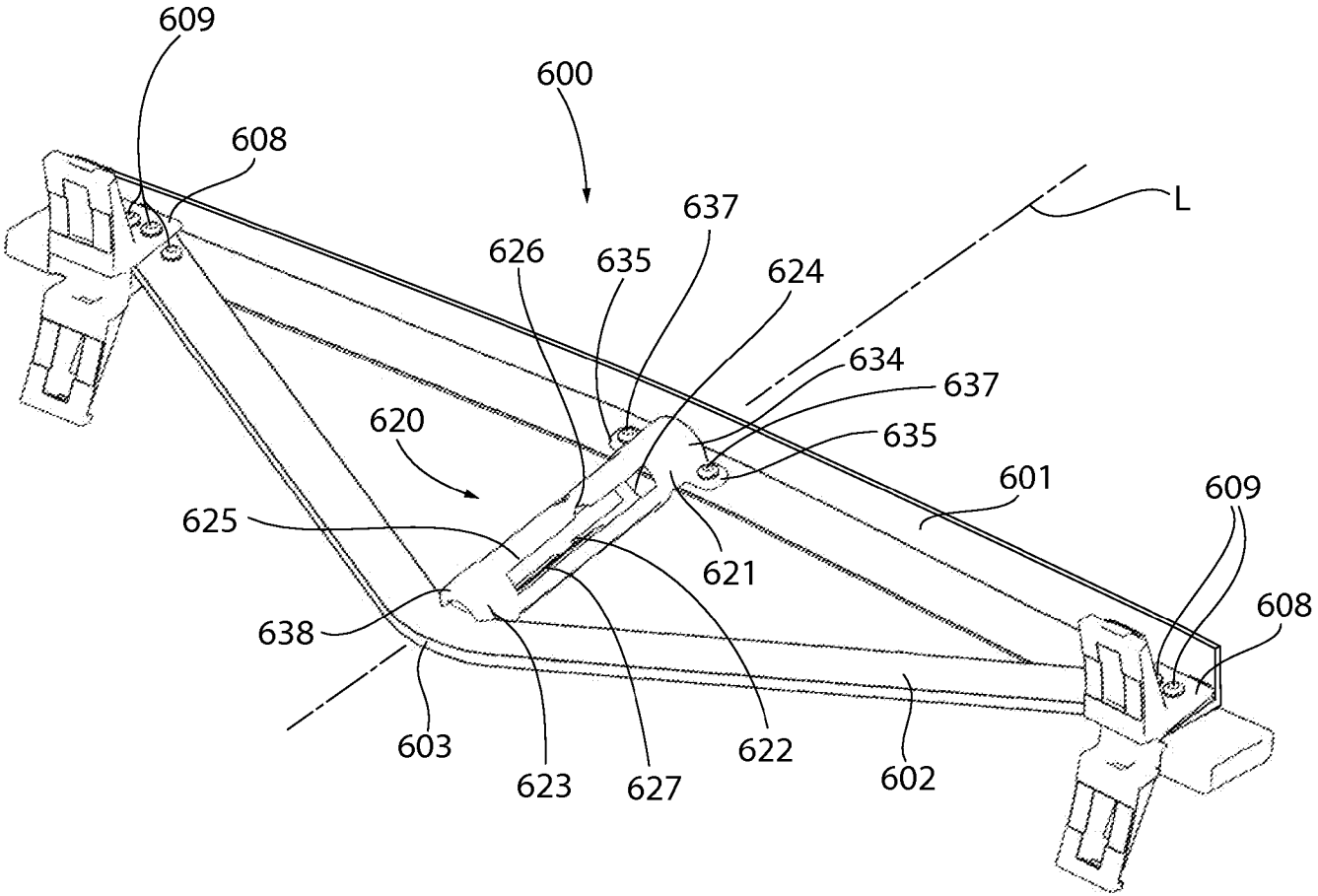
FIG. 23 is a second perspective view of the brake beam assembly of FIG. 22.
Figure 24:
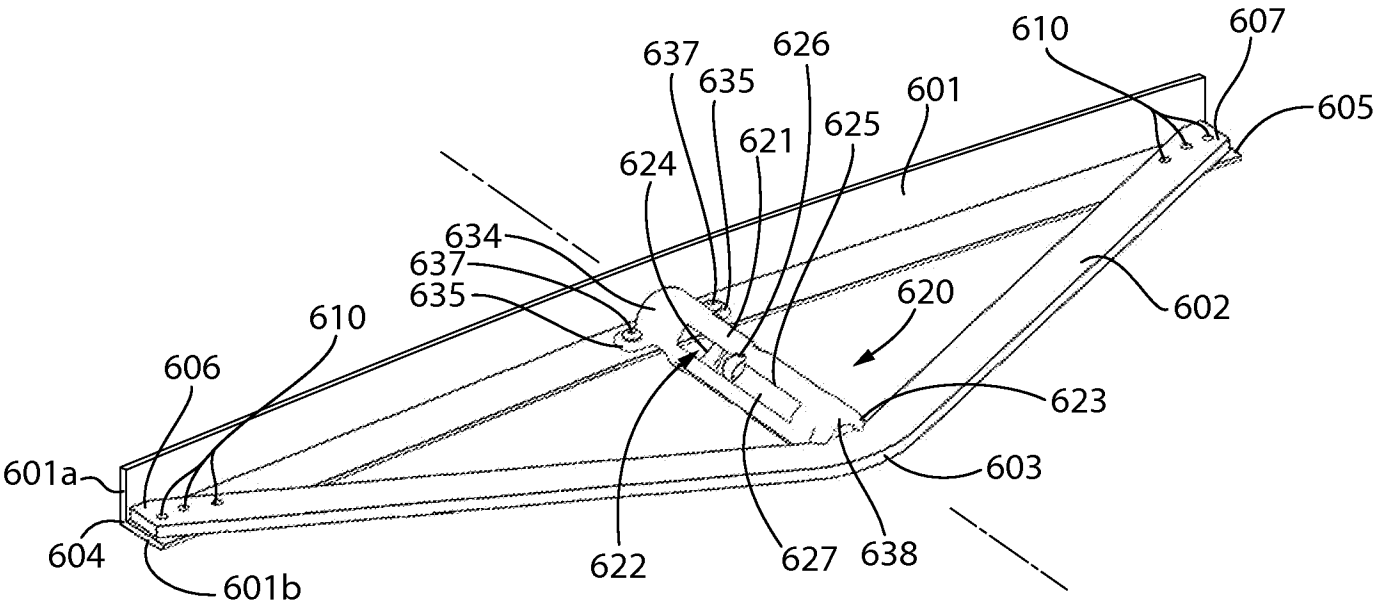
FIG. 24 is a third perspective view of the brake beam assembly of FIG. 22 with the brake heads removed.
Figure 25:
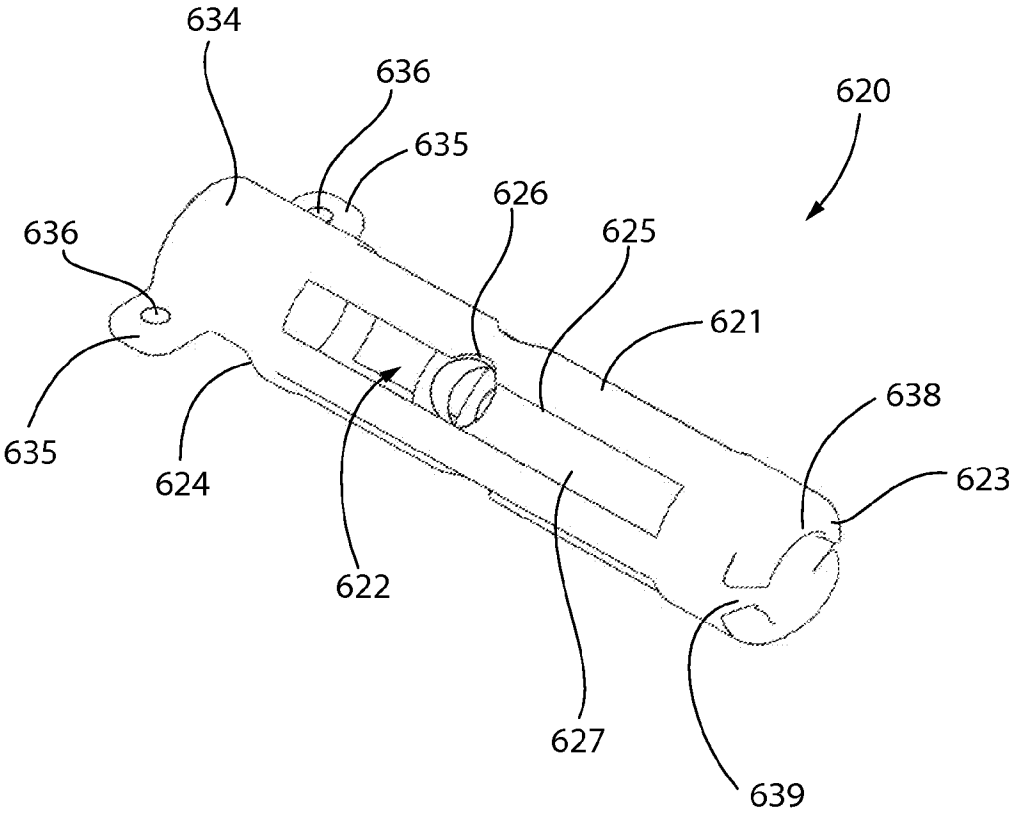
FIG. 25 is an upper proximal perspective view of a strut for a brake beam assembly according to another embodiment.
Figure 26:
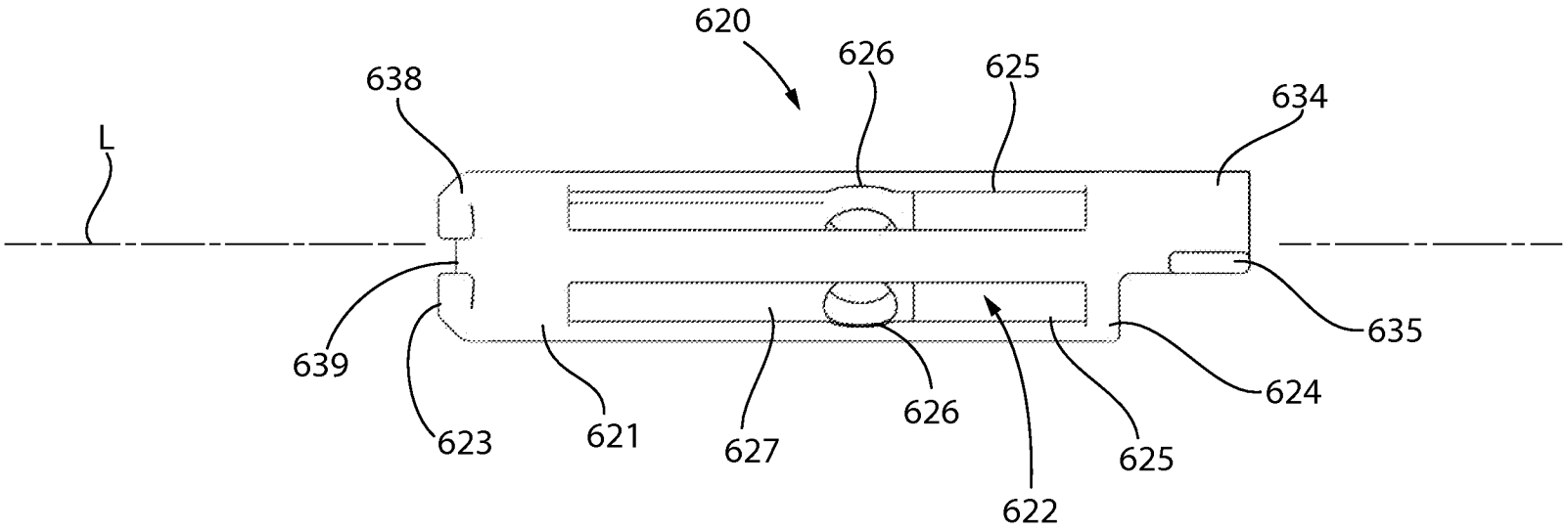
FIG. 26 is a side view of the strut of FIG. 25.
Figure 27:
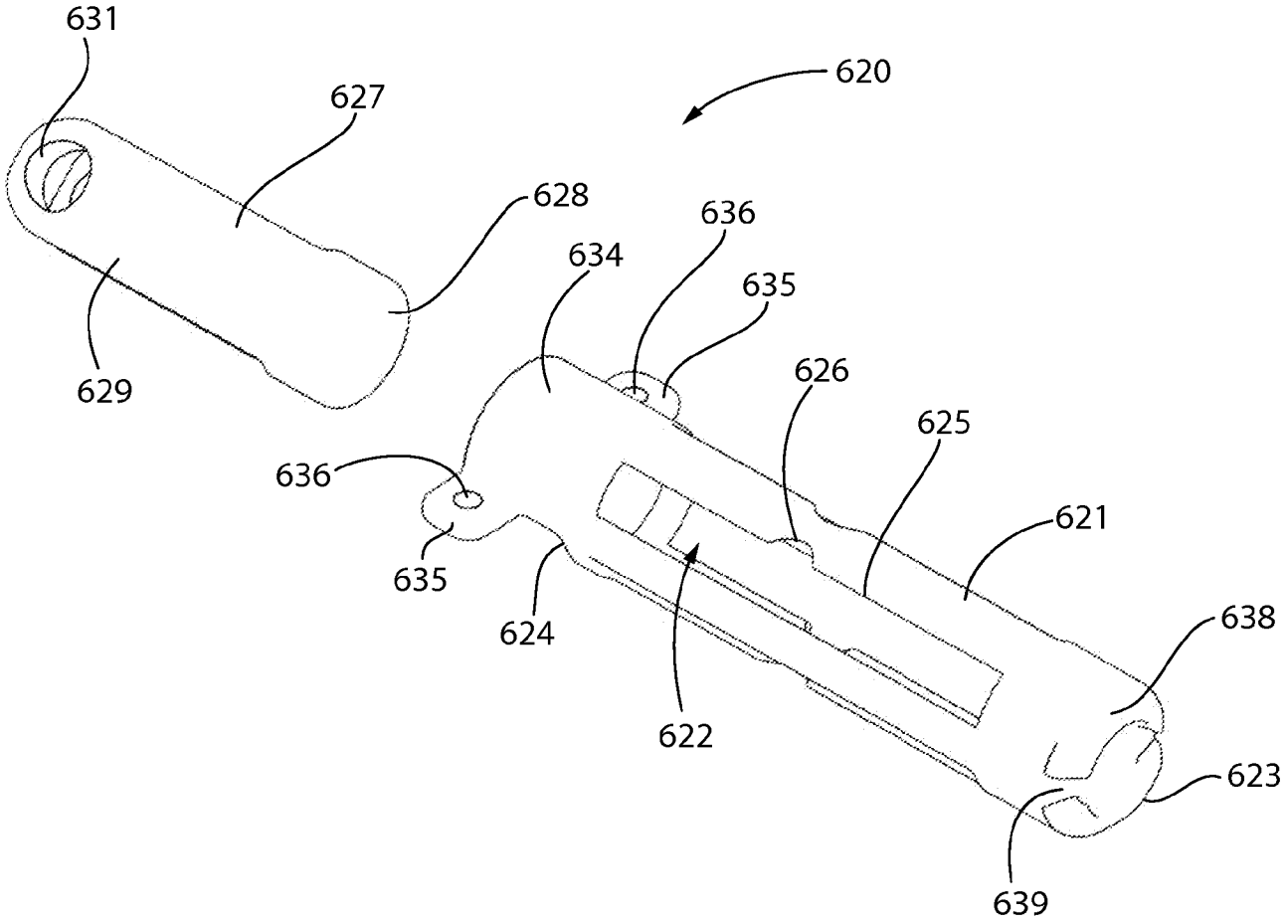
FIG. 27 is an exploded upper proximal perspective view of the strut of FIG. 25.
Figure 28:
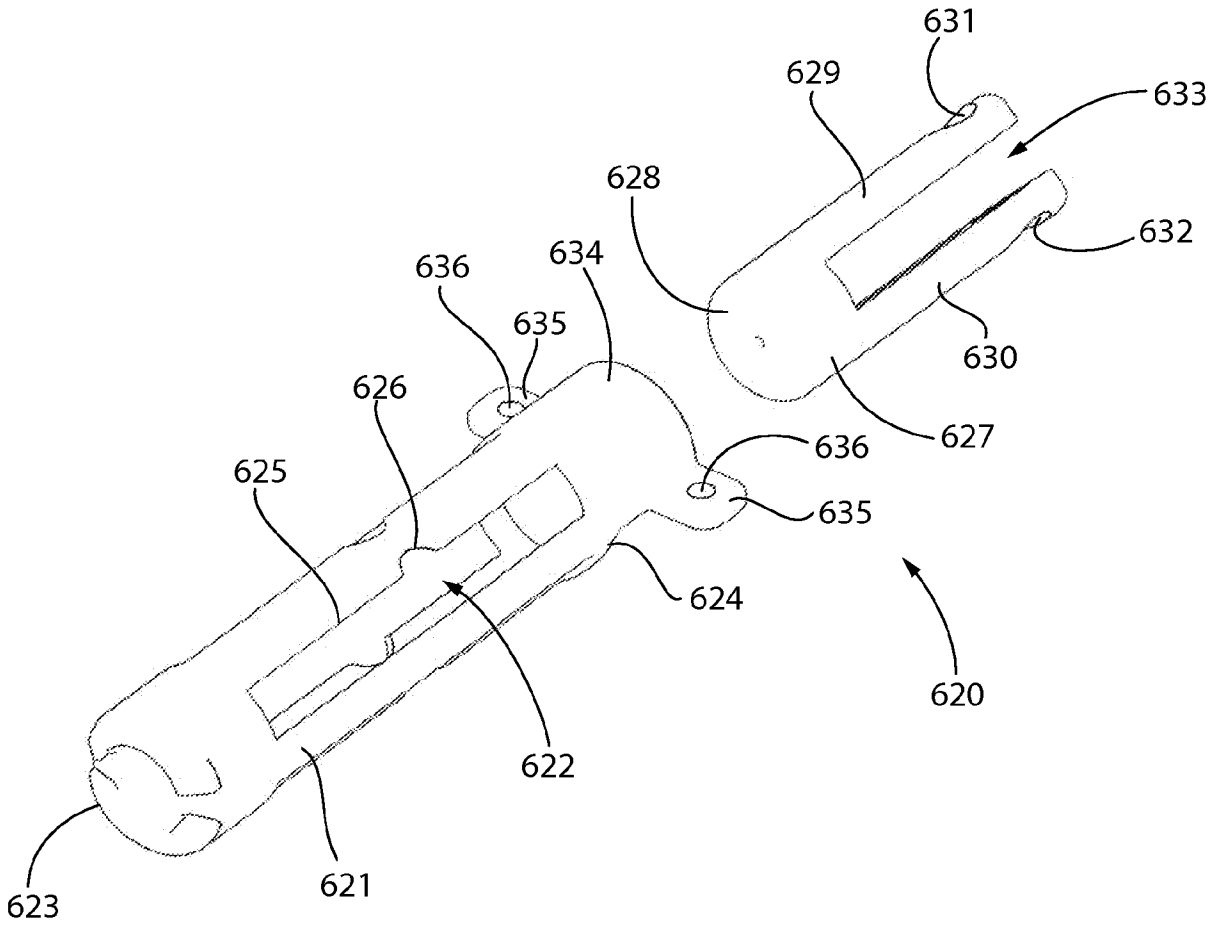
FIG. 28 is another exploded upper proximal perspective view of the strut of FIG. 25.
Figure 29:
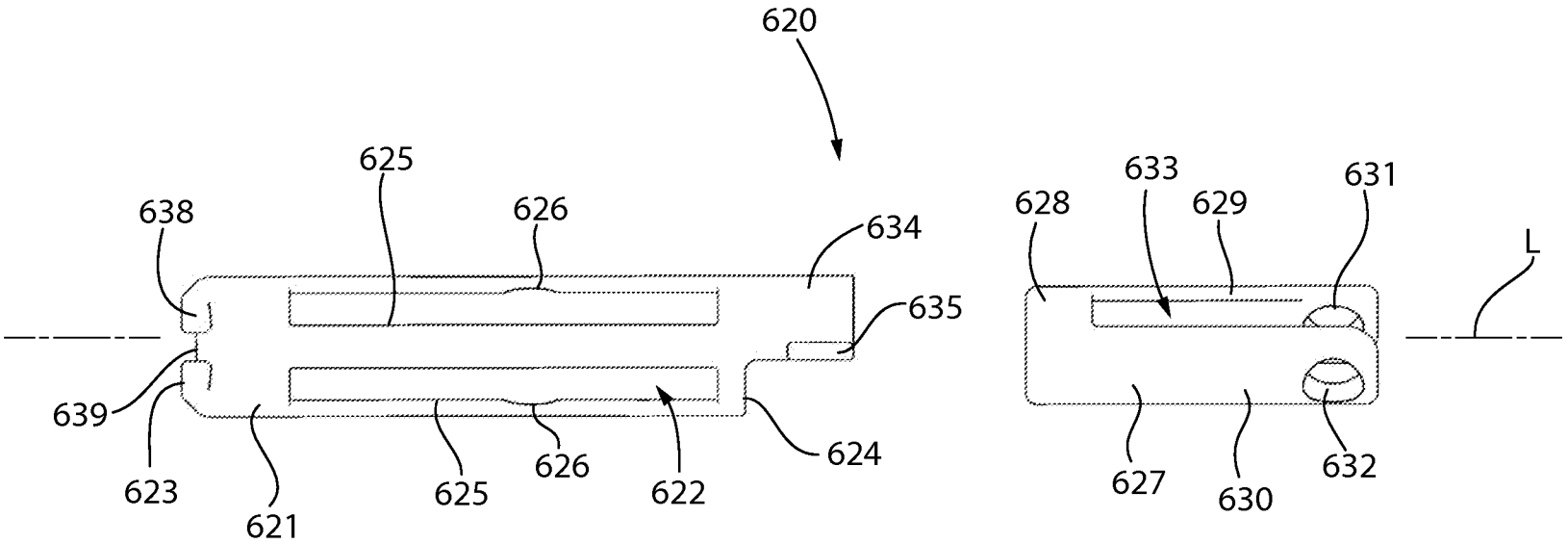
FIG. 29 is an exploded side view of the strut of FIG. 25.

With reference to FIGS. 22-24, a brake beam assembly 600 is shown according to another embodiment. The brake beam assembly 600 includes a compression member 601 having a first end 604 and a second end 605, and a tension member 602 having a first end 606 and a second end 607 and a substantially V-shape defining an apex 603. As shown, the compression member 601 may be a square L-beam having a vertical leg 601*a* and a horizontal leg 601*b*. The tension member 602 may be a flat member bent at its center to form the apex 603. The first end 606 and the second end 607 of the tension member 602 are connected to the first end 604 and the second end 605 of the compression member 601, respectively. A brake head 608 is provided at each end of the brake beam assembly 600. Each brake head 608 includes a recess in which the respective ends 604, 605, 606, 607 of the compression member 601 and the tension member 602 are at least partially received. In particular, the first and second ends 604, 605 of the compression member 601 and the first and second ends 606, 607 of the tension member 602 include holes 610 defined therein which may be aligned when the tension member 602 is assembled onto the horizontal leg 601*b* of the compression member 601 such that the compression member 601 and the tension member 602 may be secured with fasteners 609. Some or all of the holes 610 may also be aligned with holes extending through the respective brake head 608 such that the fasteners 609 also serve to connect the brake heads 608 to the respective ends 604, 605, 606, 607 of the compression member 601 and the tension member 602.

As shown in FIGS. 22-24, a strut 620 extends between the compression member 601 and the apex 603 of the tension member 602. The strut 620 includes a strut body 621 that has at least one slot defined therein that receives and supports a brake lever 18 (shown in FIGS. 1 and 2) of a brake actuator assembly, which extends through the strut body 621 non-parallel to the longitudinal axis L of the strut body 621. At least a portion of the strut body 621 is rotatable about the longitudinal axis L of the strut body 621 with respect to the strut 620 such that the at least one slot may be oriented at opposing angles with respect to a horizontal plane defined by the first end 604 and the second end 605 of the compression member 601 and the apex 603 of the tension member 602. Accordingly, the brake lever retained within the slot will also be oriented at one of the opposing angles such that the brake lever can be positioned in a right-hand configuration or a left-hand configuration depending upon the need for one configuration or the other as a replacement part. In particular, the rotatable portion of the strut body 621 is rotatable to orient the slot at opposing angles of about 40° with respect to the horizontal plane defined by the ends 604, 605 of the compression member 601 and the apex 603 of the tension member 602. Accordingly, the rotatable portion of the strut body 621 is rotatable at least 80° about the longitudinal axis L of the strut body 621 such that the slot can receive the brake lever at one of the two opposing 40° angles with respect to the horizontal plane, as is illustrated in FIGS. 1 and 2 with reference to another embodiment.

With reference to FIGS. 22-29, the strut 620 includes a strut body 621 extending along a longitudinal axis L between a proximal end 623 and a distal end 624. The strut 620 also includes a compression member engager 634 connected to the distal end 624 of the strut body 621, which connects the strut body 621 to the compression member 601, and a tension member engager 638 connected to the proximal end 623 of the strut body 621, which engages the tension member 602 at the apex 603.

The strut body 621 includes an internal wall defining an internal cavity 622 extending longitudinally through the strut body 621 from the proximal end 623 of the strut body 621 to the distal end 624 of the strut body 621. The proximal end 623 of the strut body 621 is defined by a wall that closes off the internal cavity 622. The distal end 624 of the strut body 621 is defined by an opening that allows access to the internal cavity 622. Two pairs of opposing elongated openings 625 extend through the strut body 621 from the internal wall to an exterior of the strut body 621 to place the internal cavity 622 in communication with the exterior of the strut body 621. The openings 625 each include an arcuate notch 626 to allow a fastener to extend through the openings 625 for securing a brake lever to the strut 620. The strut body 621 includes a first stationary portion that is non-rotatably connected to the compression member engager 634 and the tension member engager 638. The first stationary portion includes the internal wall defining the internal cavity 622, and at least partially defines the proximal end 623 and the distal end 624 of the strut body 621.

The strut body 621 also includes a second portion, which includes a strut insert 627 that is slidably and rotatably disposed within the internal cavity 622 of the strut body 621. The strut insert 627 is a U-shaped member defined by a proximal wall 628 and two upstanding cylindrical sidewalls 629, 630 that conform to the shape of the internal cavity 622 of the strut body 621. The sidewalls 629, 630 are spaced apart to define a separation 633 in the strut insert 627 that is configured to receive and support the brake lever. Openings 631, 632 are defined in each of the respective sidewalls 629, 630 near the distal end of the strut insert 627 for receiving the fastener pivotably supporting the brake lever on the strut 620. The strut insert 627 is rotatably received in the internal cavity 622 with the proximal wall 628 of the strut insert 627 positioned at the proximal end 623 of the strut body 621. The strut insert 627 is rotated about the longitudinal axis L within the internal cavity 622 of the strut body 621 with respect to the stationary portion of the strut body 621, the compression member engager 634, and the tension member engager 638 to align the separation 633 with one of the pairs of opposing elongated openings 625 to form a slot for receiving and supporting the brake lever. In particular, the openings 625 in the strut body 621 are positioned to align the brake lever at one of the two opposing 40° angles. The fastener is extended through the other of the pair of openings 625 not defining the slot and the openings 631, 632 in the strut insert 627. The distal end 624 of the strut body 621 is defined by the opening, which provides access to the internal cavity 622 for placement of the strut insert 627 in the internal cavity 622.

As shown in FIGS. 22-29, the compression member engager 634 of the strut 620 includes an extension of the strut body 621 on an upper side of the strut body 621 extending past the distal end 624 of the strut body 621 to engage the compression member 601 of the brake beam assembly 600. The compression member engager 634 also includes at least one tab 635 extending from a side of the extension. In particular, two tabs 635 extend from the lateral sides of the extension. The tabs 635 each include an opening 636 that receives a fastener 637, which non-rotatably fastens the compression member engager 634 on the compression member 601 to connect the strut body 621 to the compression member 601. As shown in FIGS. 22-24, when fastened, the compression member 601 overlaps with the opening in the distal end 624 of the strut body 621.

Further, as shown in FIGS. 22-29, the tension member engager 638 of the strut 620 is integrally formed in the proximal end 623 of the strut body 621. The tension member engager 638 has a channel 639 defined therein configured to receive the tension member of the brake beam assembly.

It is to be appreciated that the components of the strut 20, 100, 200, 300, 400, 500, 620 according to any one of the above-discussed embodiments may be formed from any material or materials known to be suitable to those having ordinary skill in the art. According to a particular embodiment, the strut 20, 100, 200, 300, 400, 500, 620 is formed entirely or partially from cast iron materials.

With reference to the above-detailed embodiments, a method of changing an orientation of a strut of a brake beam assembly, according to one embodiment, includes the steps of providing a strut 20, 100, 200, 300, 400, 500, 620 according to any one of the above-detailed embodiments and rotating at least a portion of the strut body 21, 101, 201, 301, 401, 501, 621 in a direction about the longitudinal axis L of the strut body 21, 101, 201, 301, 401, 501, 621 with respect to the compression member engager and the tension member engager to orient the slot at an angle with respect to the horizontal plane extending through the longitudinal axis L of the strut body 21, 101, 201, 301, 401, 501, 621. The method may further include the step of rotating the at least a portion of the strut body 21, 101, 201, 301, 401, 501, 621 in an opposing direction about the longitudinal axis L of the strut body 21, 101, 201, 301, 401, 501, 621 with respect to the compression member engager and the tension member engager to orient the slot at a reverse angle with respect to the horizontal plane. The angle may be about 40° in the direction about the longitudinal axis L and the reverse angle may be about 40° in the opposing direction about the longitudinal axis L.

While embodiments of a universal brake beam strut were provided in the foregoing description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are to be embraced within their scope.

The invention claimed is:

1. A strut for a brake beam assembly, the strut comprising:

a strut body extending along a longitudinal axis between a proximal end and a distal end, the strut body including at least one slot defined in the strut body configured to receive and support a brake lever;

a compression member engager configured to connect the strut body to a compression member of the brake beam assembly, the compression member engager being connected to the distal end of the strut body; and a tension member engager configured to engage a tension member of the brake beam assembly, the tension member engager being connected to the proximal end of the strut body, wherein the strut body comprises a stationary portion defining the proximal end of the strut body and the distal end of the strut body, wherein the stationary portion of the strut body is non-rotatably connected to the compression member engager and the tension member engager, and wherein the stationary portion of the strut body includes an internal wall defining an internal cavity of the strut body extending longitudinally through the strut body from the proximal end of the strut body to the distal end of the strut body and two pairs of opposing elongated openings extending through the strut body from the internal wall to an exterior of the strut body, wherein the strut body also comprises a strut insert slidably and rotatably disposed within the internal cavity of the strut body, wherein the strut insert at least partially defines the at least one slot and is rotatable within the internal cavity of the strut body about the longitudinal axis of the strut body with respect to the stationary portion of the strut body, the compression member engager, and the tension member engager such that the at least one slot may be oriented at opposing angles with respect to a horizontal plane extending through the longitudinal axis of the strut body, and wherein the at least one slot of the strut body is defined by the strut insert and at least one pair of the two pairs of opposing elongated openings.

2. The strut for a brake beam assembly according to claim 1, wherein the opposing angles are about 40° with respect to the horizontal plane and the strut insert is rotatable at least 80° about the longitudinal axis of the strut body.

3. The strut for a brake beam assembly according to claim 1, wherein the strut insert comprises a U-shaped member defined by a proximal wall and two spaced-apart sidewalls that define a separation extending along the longitudinal axis of the strut body, and wherein the separation of the strut insert is aligned with one pair of the two pairs of opposing elongated openings to form the at least one slot of the strut body.

4. The strut for a brake beam assembly according to claim 3, wherein each of the two spaced-apart sidewalls of the strut insert includes an opening configured to receive a fastener for connecting the brake lever to the strut body.

5. The strut for a brake beam assembly according to claim 1, wherein the distal end of the strut body is defined by an opening providing access to the internal cavity for placement of the strut insert in the internal cavity.

6. The strut for a brake beam assembly according to claim 1, wherein each of the elongated openings includes an arcuate portion configured to accommodate a fastener for connecting the brake lever to the strut body.

7. The strut for a brake beam assembly according to claim 1, wherein the compression member engager comprises an extension on an upper side of the strut body extending past the distal end of the strut body and at least one tab extending from a side of the extension, the at least one tab including an opening configured to receive a fastener for fastening the compression member engager on the compression member of the brake beam assembly.

8. The strut for a brake beam assembly according to claim 1, wherein the compression member engager comprises a clamp assembly configured to engage the compression member of the brake beam assembly, and wherein the clamp assembly includes a first clamp member disposed on the distal end of the strut body, a second clamp member removably secured to the distal end of the strut body to be aligned with the first clamp member, and at least one fastener configured to connect the second clamp member to the strut body and to fasten the clamp assembly on the compression member.

9. The strut for a brake beam assembly according to claim 1, wherein the tension member engager is integrally formed in the proximal end of the strut body and has a channel defined therein configured to receive the tension member.

10. A brake beam assembly, comprising:

a compression member having a first end and a second end;

a tension member having a first end and a second end and defining a substantially V-shape with an apex, the first and second ends of the tension member being connected to the first and second ends of the compression member, respectively; and a strut extending between the compression member and the apex of the tension member, the strut comprising:

a strut body extending along a longitudinal axis between a proximal end and a distal end, the strut body including at least one slot defined in the strut body configured to receive and support a brake lever;

a compression member engager connecting the strut body to the compression member, the compression member engager being connected to the distal end of the strut body; and a tension member engager engaging the tension member at the apex, the tension member engager being connected to the proximal end of the strut body, wherein the strut body comprises a stationary portion defining the proximal end of the strut body and the distal end of the strut body, wherein the stationary portion of the strut body is non-rotatably connected to the compression member engager and the tension member engager, and wherein the stationary portion of the strut body includes an internal wall defining an internal cavity of the strut body extending longitudinally through the strut body from the proximal end of the strut body to the distal end of the strut body and two pairs of opposing elongated openings extending through the strut body from the internal wall to an exterior of the strut body, wherein the strut body also comprises a strut insert slidably and rotatably disposed within the internal cavity of the strut body, wherein the strut insert at least partially defines the at least one slot and is rotatable within the internal cavity of the strut body about the longitudinal axis of the strut body with respect to the stationary portion of the strut body, the compression member engager, and the tension member engager such that the at least one slot may be oriented at opposing angles with respect to a horizontal plane extending through the longitudinal axis of the strut body, and wherein the at least one slot of the strut body is defined by the strut insert and at least one pair of the two pairs of opposing elongated openings.

11. The brake beam assembly according to claim 10, wherein the opposing angles are about 40° with respect to the horizontal plane and the strut insert is rotatable at least 80° about the longitudinal axis of the strut body.

12. The brake beam assembly according to claim 10, wherein the strut insert comprises a U-shaped member defined by a proximal wall and two spaced-apart sidewalls that define a separation extending along the longitudinal axis of the strut body, and wherein the separation of the strut insert is aligned with one pair of the two pairs of opposing elongated openings to form the at least one slot of the strut body.

13. The brake beam assembly according to claim 10, wherein the distal end of the strut body is defined by an opening providing access to the internal cavity for placement of the strut insert in the internal cavity.

14. The brake beam assembly according to claim 10, wherein the compression member engager comprises an extension on an upper side of the strut body extending past the distal end of the strut body and at least one tab extending from a side of the extension, the at least one tab including an opening configured to receive a fastener for fastening the compression member engager on the compression member of the brake beam assembly.

15. The brake beam assembly according to claim 10, wherein the compression member engager comprises a clamp assembly configured to engage the compression member of the brake beam assembly, and wherein the clamp assembly includes a first clamp member disposed on the distal end of the strut body, a second clamp member removably secured to the distal end of the strut body to be aligned with the first clamp member, and at least one fastener configured to connect the second clamp member to the strut body and to fasten the clamp assembly on the compression member.

16. The brake beam assembly according to claim 10, wherein the tension member engager is integrally formed in the proximal end of the strut body and has a channel defined therein configured to receive the tension member.

17. A strut for a brake beam assembly, the strut comprising:

a strut body extending along a longitudinal axis between a proximal end and a distal end, the strut body including at least one slot defined in the strut body configured to receive and support a brake lever extending through the strut body non-parallel to the longitudinal axis of the strut body;

a compression member engager configured to connect the strut body to a compression member of the brake beam assembly, the compression member engager being connected to the distal end of the strut body;

at least one fastener configured to engage the compression member engager to fasten the compression member engager on the compression member; and a tension member engager configured to engage a tension member of the brake beam assembly, the tension member engager being connected to the proximal end of the strut body, wherein at least a portion of the strut body is rotatable about the longitudinal axis of the strut body with respect to the compression member engager and the tension member engager such that the at least one slot may be oriented at opposing angles with respect to a horizontal plane extending through the longitudinal axis of the strut body, wherein the compression member engager comprises at least two clamp members removably connected to the strut body by the at least one fastener, and wherein the at least one fastener is configured to connect the strut body to the at least two clamp bodies such that the strut body is fixed in a position oriented at one of the opposing angles, and wherein the at least one fastener is configured to cause the at least two clamp bodies to non-rotatably engage the compression member.

* * * * *